US007470219B2

(12) United States Patent
Larson

(10) Patent No.: US 7,470,219 B2
(45) Date of Patent: Dec. 30, 2008

(54) TRAINING APPARATUS FOR SKATING-TYPE SPORTS

(76) Inventor: Cadmar Larson, 10900 Sidaway Road, Richmond, British Columbia (CA) V6W 1C4

( * ) Notice: Subject to any disclaimer, the term of this patent is extended or adjusted under 35 U.S.C. 154(b) by 0 days.

(21) Appl. No.: 11/594,913

(22) Filed: Nov. 9, 2006

(65) Prior Publication Data

US 2007/0117687 A1 May 24, 2007

Related U.S. Application Data

(60) Provisional application No. 60/737,749, filed on Nov. 18, 2005, provisional application No. 60/735,185, filed on Nov. 10, 2005.

(51) Int. Cl.
*A63B 22/00* (2006.01)
*A63B 22/02* (2006.01)
*A63B 22/18* (2006.01)

(52) U.S. Cl. ..... 482/54; 482/71; 434/253

(58) Field of Classification Search ..... 482/51, 482/52, 54, 57, 66, 68, 70, 71, 142, 146; 434/253; 473/440; 280/818, 842; 198/860.1, 198/861.1; *A63B 69/18*
See application file for complete search history.

(56) References Cited

U.S. PATENT DOCUMENTS 3,420,385 A * 1/1969 Verrinder ..... 414/792
3,834,693 A 9/1974 Poppenberger
4,274,625 A * 6/1981 Gaetano ..... 482/54
4,595,195 A * 6/1986 Miehlich ..... 482/71
4,629,181 A 12/1986 Krive
4,781,372 A 11/1988 McCormack
5,385,520 A 1/1995 Lepine et al.
5,391,131 A * 2/1995 Gordon ..... 482/71
5,425,691 A 6/1995 Van Der Hoeven
5,509,870 A 4/1996 Lloyd
5,749,811 A 5/1998 Wilson
6,010,432 A * 1/2000 Vawter ..... 482/54
6,042,511 A 3/2000 Bulloch
6,387,015 B1 * 5/2002 Watson ..... 482/54
6,893,382 B1 * 5/2005 Moon et al. ..... 482/54
2005/0209061 A1 9/2005 Crawford et al.

* cited by examiner

*Primary Examiner*—LoAn H. Thanh
*Assistant Examiner*—Oren Ginsberg
(74) *Attorney, Agent, or Firm*—Fasken Martineau DuMoulin LLP

(57) ABSTRACT

A training apparatus configured for skating-type sports whereon a user can perform training, exercising, strengthening and conditioning while wearing footgear designed for use in skating-type sports. The training apparatus comprises a pair of interconnected opposed matching elongate platforms extending backward and away from each other preferably at an angle equal to or less than 90°. Each platform is provided with an abrasion-resistant exercise surface assembly configured to slidingly communicate with and to controllably engage and disengage a user's footgear. Each platform is provided with a controllably pivotable and lockable foot stop assembly. The training apparatus is provided with an electronic device configured to measure, monitor, record and report at least one of a user's vital signs and a physical performance criterion associated with skating-type motions and activities. The training apparatus is optionally provided with a vertically adjustable knee brace apparatus.

35 Claims, 18 Drawing Sheets

(b)

(b)

TRAINING APPARATUS FOR SKATING-TYPE SPORTS

CROSS-REFERENCE TO RELATED APPLICATIONS

This application claims priority from my Provisional Application Ser. No. 60/735,185 filed Nov. 10, 2005 and Ser. No. 60/737,749 filed Nov. 18, 2005, and my International Patent Application No. PCT/CA2006/001237 filed Jul. 27, 2006, currently pending.

TECHNICAL FIELD

This invention relates to exercise and training apparatus. More particularly, the present invention is directed to apparatus for training, exercising, strengthening and conditioning for skating-type sports activities.

BACKGROUND OF THE INVENTION

Ice skating, rollerblading and cross country skiing activities require similar types of controlled muscle movements for forward and rearward propulsion, for turning and for stopping. Forward propulsion is generally accomplished by securely planting a first foot at an acute angle to the longitudinal direction of travel, then thrusting forward from the planted foot while at the same time transferring body weight to the opposite second foot that is leading the skating motion. As the thrusting motion is beginning from the planted first foot, the opposite second foot is generally orientated to a perpendicular line extending from the acute angle set by the planted first foot. As the thrusting motion is continued, the opposite second foot glides forward in a straight line that is perpendicular to the angle of the planted foot, but typically at an oblique angle to the general longitudinal direction of travel. As the thrusting motion is completed, the individual's weight is completely transferred to the opposite leading second foot as it is gliding forward while the planted first foot is raised and brought forward so that it is now ahead of the opposite second foot. The forward gliding second foot is then securely planted at an acute angle to the longitudinal direction of travel, while the now leading first foot is generally orientated to a perpendicular line extending from the angle set by planted second foot. In a forward skating motion, the perpendicular line followed by the first foot is substantially parallel to the acute angle set when it is planted. This sequence of events is generally reversed for rearward propulsion. The speed of propulsion provided to the gliding feet is primarily controlled by the degree and duration of muscular leg force applied by the planted feet during each thrust/glide sequence. The planted foot is stabilized by forcing and holding it for the duration of the thrusting motion, into an acute angle relative to the surface being skated on thereby cutting into the surface with an edge of the skate or ski, or alternatively, by friction-forcing the side walls of rollerblade wheels against the skating surface. The forward gliding foot is held perpendicular to the skating surface to minimize the friction or drag from the skate or ski.

Turning on skates and skis is accomplished by positioning and holding the leading gliding foot at an angle to the skating surface during each plant-thrust-glide sequence. For example, to make a right turn, the individual's right foot would be held at an acute angle relative to the outside of the foot during its gliding motion while their left foot would be held at an obtuse angle relative to the outside of that foot during its gliding motion. The tightness of the turn is controlled concurrently by the degrees of the angles held by the feet during their individual gliding motions.

Stopping can be accomplished by placing both feet in parallel in front of and perpendicular to the body's direction of travel at complementary obtuse/acute angles so that the edges of the blades scrape along and dig into the skating surface thereby stopping the forward momentum. Alternatively, the leading foot may be held at an obtuse angle to the general direction of travel such that the blade edge on the inside of the foot is scraping and/or cutting into the skating surface. Another alternative stopping method is dragging one of the feet behind the body in a generally perpendicular orientation to the direction of travel and may optionally be forced into the skating surface.

Successful execution and enjoyment of skating-type sports activities require the development of muscular agility, dexterity, strength and endurance. Hockey is a particularly demanding sports activity that requires bursts of forward and rearward propulsion, rapid twisting and squirming turns and stops. Of primary importance in executing these types of movements are the muscle groups controlling: (a) the orientation and positioning of the ankles for planting, aligning and adjusting foot position during execution of the planting and thrusting motions, during turns and stops, (b) the abduction and adduction (i.e., push-pull or extension/contraction) of the leg muscles during execution of planting, thrusting and turning motions, (c) hip girdle functions (i.e., twisting, sliding from side-to-side, bending forward and backward) to maintain body balance and weight transfer during the stride/glide sequences of propulsion, turning and stopping, and (d) upper body movements to complement and enhance the vigour of and/or control over the ankle, leg and hip muscle groups. While it is desirable for individuals participating in skating-type sports activities to train and exercise each of these muscle groups to improve their execution of the skating-type movements, it is of particular importance to develop the coordination and concurrent control of the above-noted multiple muscle groups distributed throughout the body.

Numerous types of training devices and exercise apparatus have been developed for focused training and strengthening exercises for skating type activities as exemplified by:

U.S. Pat. No. 5,385,520 which discloses a motorized treadmill configured for exercising and training activities thereon while wearing ice skates;

U.S. Pat. No. 6,042,511 which discloses an exercise device comprising a pair of coupled-together platforms wherein each platform is provided with a slidable rail-track system configured to interconnect and cooperate with the slidable rail-track system provided on the other platform. The user places a foot on each platform to practice skating-type striding, presumably wearing training shoes or other such footwear;

U.S. Pat. No. 4,781,372 which discloses a pair of rotatably positionable rail-tracks, each provided with a foot-engaging stirrup. The rail-tracks are configured to communicate and cooperate with a cable/pulley operated weight-resistance-type gym equipment;

U.S. Pat. No. 4,340,214 which discloses a training apparatus comprising a fixed stand cooperating with two opposing carriage units mounted on rollers configured to move back and forth in lateral plane relative to a forward-facing body position of the user. The user's feet may be directly or indirectly secured into stirrups provided on the carriage units. The apparatus provides push-pull (i.e., extension/contraction) exercising of leg muscle groups used for skating-type motions.

SUMMARY OF THE INVENTION

Exemplary embodiments of the present invention, at least in preferred forms, are directed to exercise and training apparatus configured for training, exercising, strengthening and conditioning for skating-type sports whereon a user can practice such activities while wearing footgear designed for use in skating-type sports.

According to a preferred embodiment of the present invention, there is provided a training apparatus comprising a pair of interconnected opposed matching elongate platforms extending backward and away from each other. It is preferred that the platforms extend backward and away from each other at an angle selected from the range of 90° to 10°. The bottom surface of the training apparatus is provided with a plurality of spaced apart raising/lowering devices configured to controllably raise and lower the front and rear sections of the training apparatus and to concurrently or alternatively, raise and lower each side of the training apparatus relative to the other side. The training apparatus is preferably provided with at least one guardrail configured for demountable attachment and cooperation with at least one side portion of the training apparatus.

According one aspect, each elongate platform is provided with a base frame structure comprising two spaced-apart side rails integrally interconnected at one set of their ends, i.e., the rear end of the base frame, with a generally transverse-oriented rear end rail and the opposite set of ends with a two-section front rail. A first section of the front rail is configured to conjoin with and extend away from a first side rail at an acute angle, while the second section conjoins the second side rail with the first section of the front rail. The angle that the two elongate platforms extend away from each other is the sum of the two acute angles set by the opposing first sections of the front rails extending away from the opposing first side rails. It is preferred that each base frame structure is provided with at least one elongate bracing member integrally conjoined to the rear end rail and the front rail. Cross-braces may optionally be provided interposed the side rails or alternatively, the side rails and elongate bracing members.

According to another aspect, each elongate platform is provided with an exercise surface assembly configured to slidingly communicate with and to controllably engage and disengage a user's footgear during their execution and practice of training, exercising, strengthening and conditioning activities on the training apparatus of the present invention.

In a preferred form, the exercise surface assembly comprises a plurality of freely-spinning rollers communicating and cooperating with a plurality of roller support brackets that are demountably engaged with the base frame support and/or elongate bracing members comprising the elongate platform. It is preferable that the rollers comprise a durable abrasion-resistant polymer material. A compressible resilient material may optionally be interposed roller support brackets and base frame structure and/or the elongate bracing members.

In another preferred form, the exercise surface assembly comprises a sheet material comprising a durable abrasion-resistant polymer material. The sheet material may optionally be superposed onto an exercise surface assembly comprising a plurality of rollers.

According to yet another aspect, each elongate platform is provided with a controllably pivotable and lockable foot stop apparatus configured for communicating and cooperating with the exercise surface assembly to assist a user in setting and planting their feet in acute angles relative to the direction of forward propulsion. In a preferred form, the foot stop apparatus is configured for demountable engagement with the rear end of the elongate platform. In another preferred form, the foot stop apparatus may be configured to concurrently demountably engage the side rails of the base frame structure of the elongate platform.

According to a further aspect, there is provided a knee brace apparatus configured for engaging and cooperating with the front end of the training apparatus of the present invention. The knee brace comprises a controllable raising/lowering device communicating with a padded horizontal member extending backward from the front of the training apparatus superposed the juncture of the two elongate platforms. In a preferred form, the new brace is provided with a rearward demountable extension comprising a seat portion. In another preferred form, the raising/lowering device is interconnected with and stabilizes and upwardly and outwardly extending T-bar type guardrail.

According to yet a further aspect, there is provided an electronic device mountable on the guardrail for communicating and cooperating with the training apparatus of the present invention to measure, monitor, record and report at least one of a user's vital signs and a physical performance criterion associated with skating-type motions and activities, while the user is exercising and/or training on the apparatus. It is preferable the electronic device is configured to monitor, record and report a plurality of a user's vital signs and physical performance attribute criteria. The electronic device may optionally be configured to communicate cooperate with a second device configured for data transfer and/or data processing and/or data storage.

According to another aspect, the bottom surface of the training apparatus of the present invention is configured for demountable engagement with a lazy-susan type carousel for pivotably communicating and cooperating with said carousel.

According to yet another aspect, the two opposing front sections of the front rails of the elongate platforms are provided with an interconnecting hinge device configured to enable folding the two elongate platforms together for transport and storage. It is preferred that the rear end of one of the elongate platform is provided with a pair of caster devices for transporting on the folded training apparatus.

BRIEF DESCRIPTION OF THE DRAWINGS

The present invention will be described in conjunction with reference to the following drawings, in which:

FIG. 2(*b*) is an exploded partial perspective close-up view of an alternative aspect to the one shown in FIG. 2(*a*);

FIG. 3(*b*) is a side view of the aspect shown in FIG. 3(*a*);

FIG. 3(*c*) is an end view of the aspect shown in FIG. 3(*b*);

FIG. 4(*b*) is a longitudinal sectional view of the component shown in FIG. 4(*a*);

FIG. 4(*c*) is an exploded partial sectional view of the component shown in FIG. 4(*b*);

FIG. 6(*b*) is a plan view of the embodiment from FIG. 6(*a*) shown in a retracted position;

FIG. 7(*b*) is a perspective view from the rear of the embodiment from FIG. 6(*a*) shown in a retracted position;

FIG. 17(*b*) is a partial cross-sectional side view of the roller apparatus from FIG. 17(*a*) rotated 90°;

FIG. 17(*c*) is an end view of the roller apparatus from FIG. 17(*b*);

FIG. 18(*b*) is a partial cross-sectional side view showing the end unit from FIG. 17(*b*) communicating with a portion of the drive belt; and FIG. 18(*c*) is a partial cross-sectional side view showing the end unit from FIG. 17(*a*) cooperating with a portion of the drive belt.

DETAILED DESCRIPTION OF THE INVENTION

Figure 1:
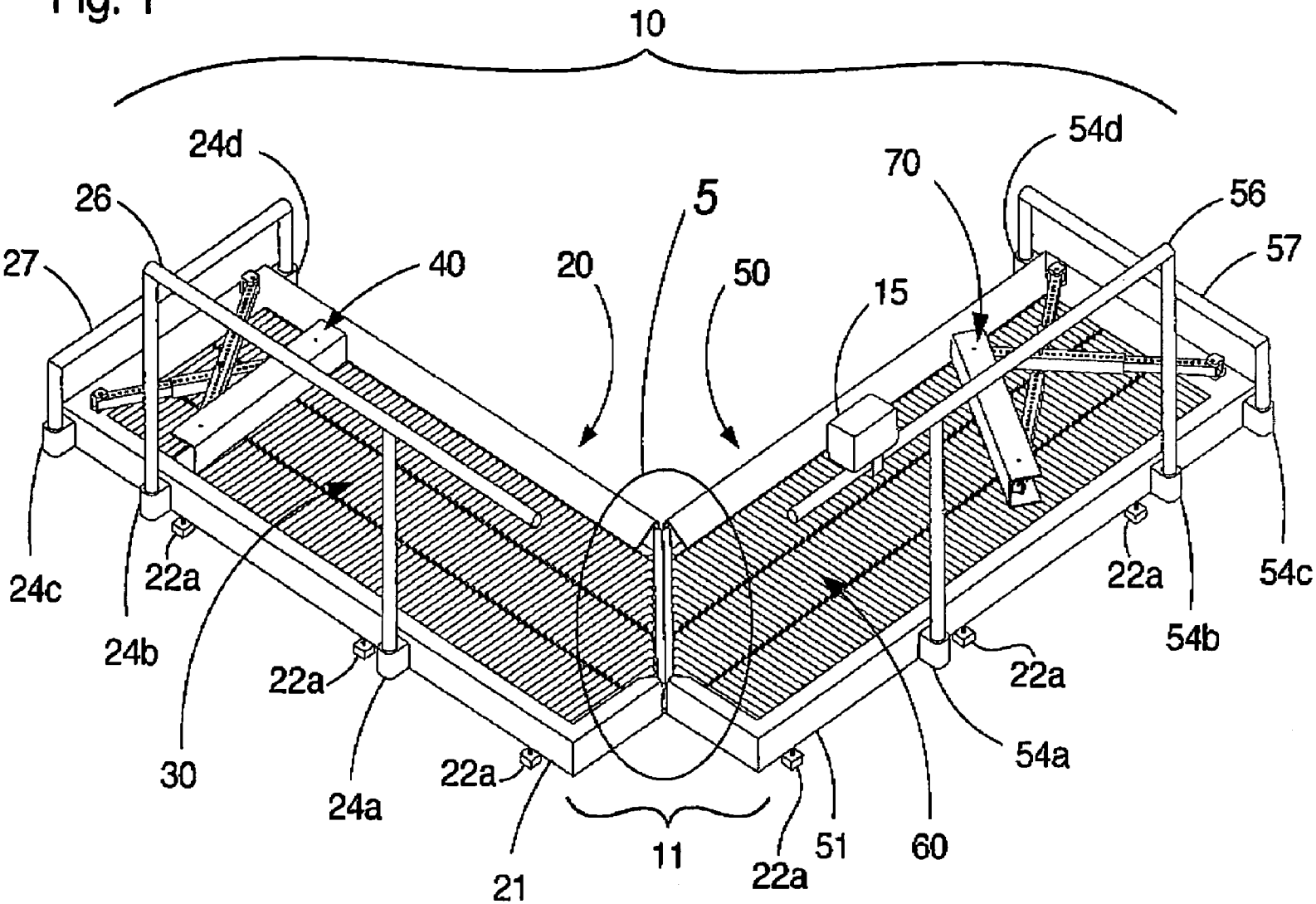
FIG. 1 is a perspective view from the front, of an exemplary preferred embodiment of the present invention.

The preferred embodiments of the present invention provide training apparatus for skating-type sports activities whereon the users' major ankle, leg, hip and upper-body muscle groups involved in executing and controlling skating motions can be concurrently exercised and trained while the users are wearing their preferred skating footgear, e.g., ice skates, roller blades, or cross-country skis. The training apparatus of the present invention is configured to enable a user wearing their preferred skating-type footgear to execute and practice the plant-thrust-glide skating motions and related body control required for forward and rearward propulsion, turning and stopping on a controllably "slippery" surface, while remaining generally fixed in place over the training apparatus. The training apparatus comprises an opposed pair of identical elongate exercise/skating platforms interconnected at one front i.e. proximal corner such that they are positioned at a right angle, i.e., 90° to each other, and extend backward and away from each other. The two opposing exercise platforms may optionally be interconnected at an oblique angle. A bridging member may optionally be provided for interconnecting the opposing platforms. The bridging member may be configured as a parallelogram or alternatively, as triangular wedge. The exercise platforms are each provided with an identical surface selected for its suitability for contacting and communicating with ice skates and/or roller blades and/or cross-country skis. The distal end of each platform is provided with an articulating foot stop pivotably mounted thereto and extending therefrom. The platforms may be optionally provided with demountable grab-bars along the outer-facing sides of the platforms and/or the front of the interconnected platforms, and may also be provided if so desired with demountable foot guards at their distal ends. The training apparatus of the present invention is provided with a plurality of individually controllable elevating and lowering devices positioned at the proximal and distal ends of each platform and optionally, at selected positions interposed the proximal and distal ends of the platforms. The elevating and lowering devices can be manipulated to raise the front of the apparatus relative to its back portion and alternatively, to raise the rear of the apparatus relative to its front portion, thereby enabling a user to exercise and train the muscle groups involved in skating-type activities while performing forward propulsion motions and rearward propulsion motions respectively. The elevating and lowering devices can also be manipulated to raise one platform of the apparatus relative to the other platform so that more body weight is distributed to a user's "weak" side thereby enabling the user to preferentially exercise, train and build the strength and endurance of those muscle groups.

A preferred exemplary embodiment of the training apparatus is shown in accompanying drawings, and is generally referred to by the numeral 10. As can best be seen in FIG. 1, the training apparatus 10 comprises a pair of identical opposed platforms 20 and 50 interconnected at the left front corner of the right-side (i.e., the user's side) platform 20 and the right front corner of the left-side (i.e., the user's side) platform 50. Each platform comprises a base frame (21 on the right-side; 51 on the left-side configured to support thereon a skating surface (30 on the right-side; 60 on the left-side). Each platform 20, 50 is provided with an articulating footstop 40, 70 mounted to and extending from the distal ends of the base frames 21, 51. Each base frame 21, 51 is provided with a plurality of spaced-apart sockets 24*a*, 24*b*, 24*c* and 24*d* on the right-side platform and 54*a*, 54*b*, 54*c* and 54*d* on the left-side platform. Grab bars 26, 56 may be demountably engaged with sockets 24*a*, 24*b*, 54*a*, and 54*b* to enable grasping by a user for stability and support while using the apparatus 10. If so desired, the spacing apart of sockets 24*a*, 24*b*, 54*a*, and 54*b* may be configured so that grab bars 26 and 56 are interchangeable and also, so that either of the grab bars 26, 56 can be removably engaged with sockets 24*a* and 54*a* thereby providing a grab bar at the front of the user to grasp for support and stability. End guards 27, 57 are provided for removable engagement with sockets 24*c*, 24*d*, 54*c* and 54*d*. If so desired, an electronic panel 15 may be mounted on one of the grab bars 26, 56.

Figure 2A:
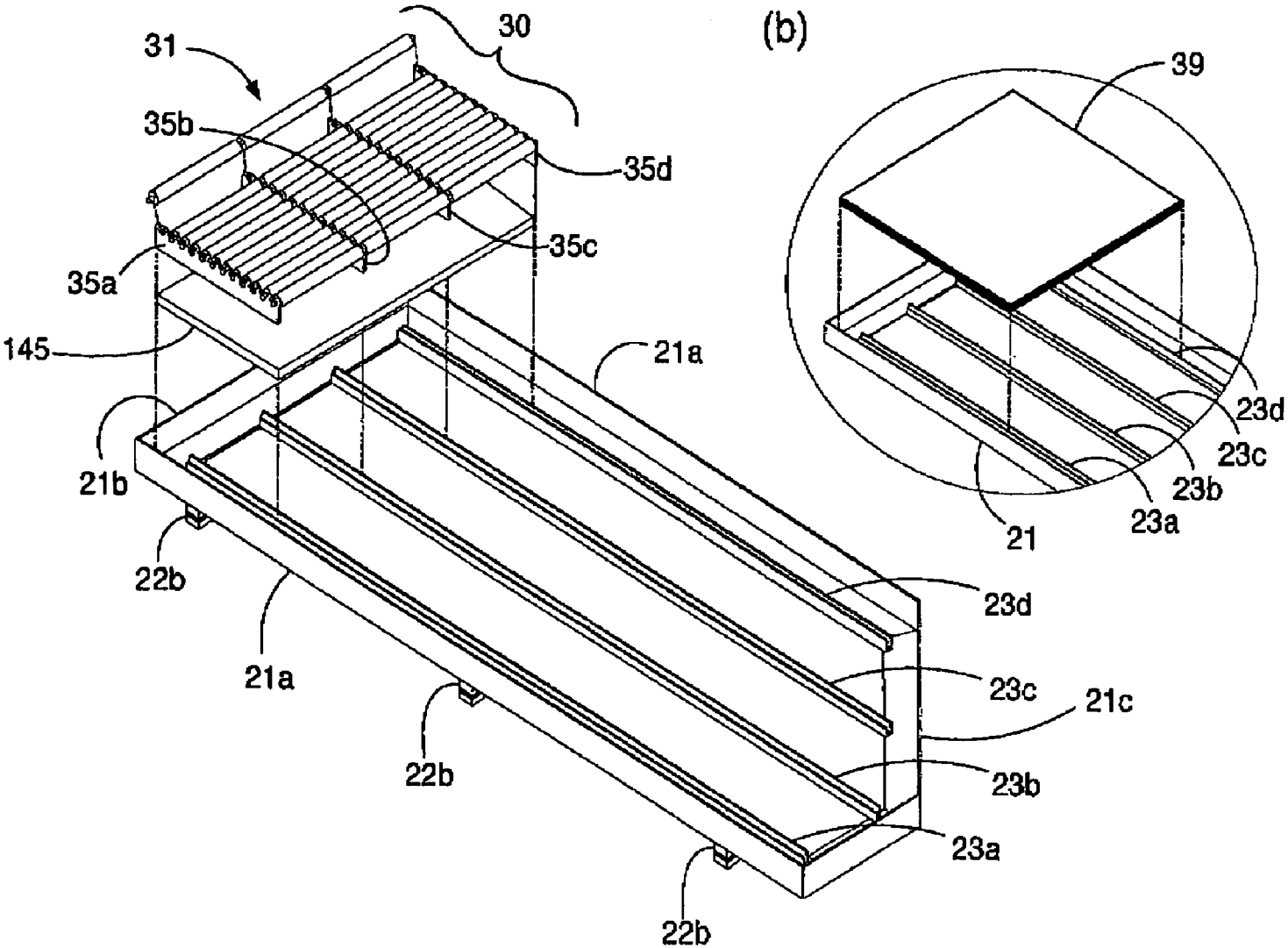
FIG. 2(*a*) is an exploded partial perspective close-up view of one aspect of the embodiment shown in FIG. 1.
Figure 5:
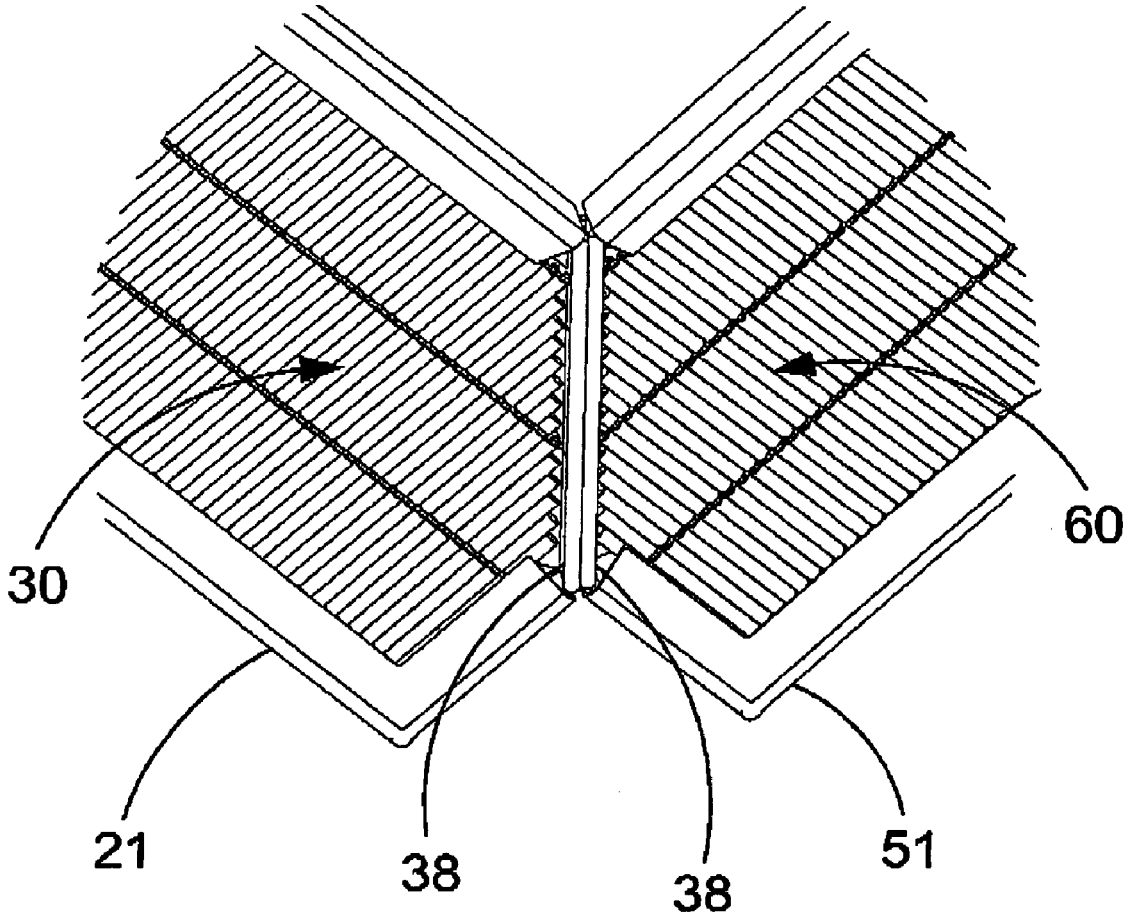
FIG. 5 is a close-up partial plan view of a section from the embodiment shown in FIG. 1.

The base frames, as exemplified by right-side base frame 21 in FIG. 2(*a*), comprise a pair of opposing side rails 21*a* interconnected at the rear end by a distal rail section 21*b* extending between one set of juxtaposed ends of the two side rail 21*a*, and at the front end by a two-section proximal rail section 21*c* extending between the opposite juxtaposed ends of the two side rails 21*a* wherein a first section of the proximal rail 21*c* is configured to extend from the side rail at an obtuse angle, whereby abutting the first section of the proximal rail of a first base frame structure with the first section of the proximal rail of a second base frame structure forms an angle selected from the range consisting of 90° to 10°. The base frame 21*a-c* is preferably provided with at least one elongate bracing support member integrally conjoining distal rail section 21*b* with the proximal rail section 21*c*, and more preferably, with a plurality of elongate bracing members shown in FIG. 2(*a*) as members 23*a*, 23*b*, 23*c*, 23*d*. If so desired, one or more cross-bracing members (not shown) may be interposed the side rails and the elongate bracing members of the base frame. It is to be noted that the A preferred exemplary embodiment for the skating surface 30 is shown in FIGS. 2 to 5 and generally comprises a plurality of roller units 31 supported within and communicating with a plurality of support brackets 35*a*, 35*b*, 35*c*, 35*d* configured for demountable engagement with U-channelled frame rails 23*a*, 23*b*, 23*c*, 23*d* integrally conjoined to the base frame 21*a-c*. Each roller unit 31 comprises a plurality of rollers 32 interconnected end-to-end by spindles 34 inserted into bores 33 extending into each end of the rollers 32. The rollers 32 are preferably a small diameter and comprise a material selected for its suitability for contacting and communicating with ice skate blades and cross-country skis. Such materials preferably include synthetic polymers configured for durability and resistance to abrasion and cutting as exemplified by ultra-high molecular weight polyethylene (UHMW-PE), extruded polyvinylidene fluoride (PVDF) resins, extruded acetal copolymers and/or homopolymers, cast nylon 6 polymers, extruded nylon 6/6 polymers, Delrin® (Delrin is a registered trade mark of E.I. du Pont de Nemours and Company), organic/inorganic nano-composite materials, and natural or synthetic rubbers. The spindles 34 may comprise a synthetic or naturally occurring high-density abrasion-resistant material selected from the list of exemplary materials noted as useful for comprising the rollers and additionally, may comprise a durable, wear-resistant metal as exemplified by stainless steel, nickel-plated bronze and tempered steel. The bores 33 provided at the opposite ends of each roller 32 are configured to slidingly communicate with and to rotate freely about spindles 34 inserted therein. Each support bracket 35 is configured to extend along and demountably engage its corresponding U-channeled frame rail 23 from the distal end to the proximal end of the base frame 20. The upper surface 37 of each support bracket 35 is provided with a plurality of matching equidistantly spaced-apart downwardly-inclined hook-shaped yokes 36 configured for releasably receiving therein and cooperating therewith the spindles 34 of multiple roller units 31. If so desired, the spindles extending from the opposing ends of each roller unit 31 may be held in place by opposing elongate guards (not shown) provided with a plurality of downward extending U-shaped channels configured to receive and retain the portions of the spindles 34 extending through outer support brackets 35*a*, said elongate guards demountably engaged with said outer support brackets 35*a*. Alternatively, instead of downward extending U-shaped channels, the elongate guard may be provided with bores configured to receive therethrough the portions of the spindles 34 extending through an outer support bracket 35*a*. The support brackets 35 are set into the frame rails 23 with the bases of the hook-shaped yokes 36 facing the proximal end of the base frame 20. If so desired, the stability of the skating surface 30 may be stiffened by integrally conjoining adjacent frame rails 23 and/or support brackets 35 with reinforcing crossmembers (not shown). Individual roller units 31 are then loaded into the support brackets 35 thereby producing a generally flat skating surface 30 comprising a plurality of closely spaced-together freely rotatable rollers 32. The corners of the base frames 21, 51 where the platforms 20, 50 are interconnected, best seen in FIG. 5, are provided with at least one roller 38 extending along the interconnecting edges of base frames 21, 51. Platform 50 opposite platform 20 is provided with a skating surface 60 configured as described for skating surface 30. Those skilled in these arts will understand that each roller 32 can rotate freely and independently of the other rollers 32 in both forward and rear ward directions to provide slippage and purchase in response to contact, communication and cooperation with a skate blade during the plant-thrust-glide sequence depending on the direction of force applied by the user during execution of the skating motions.

Figure 16:
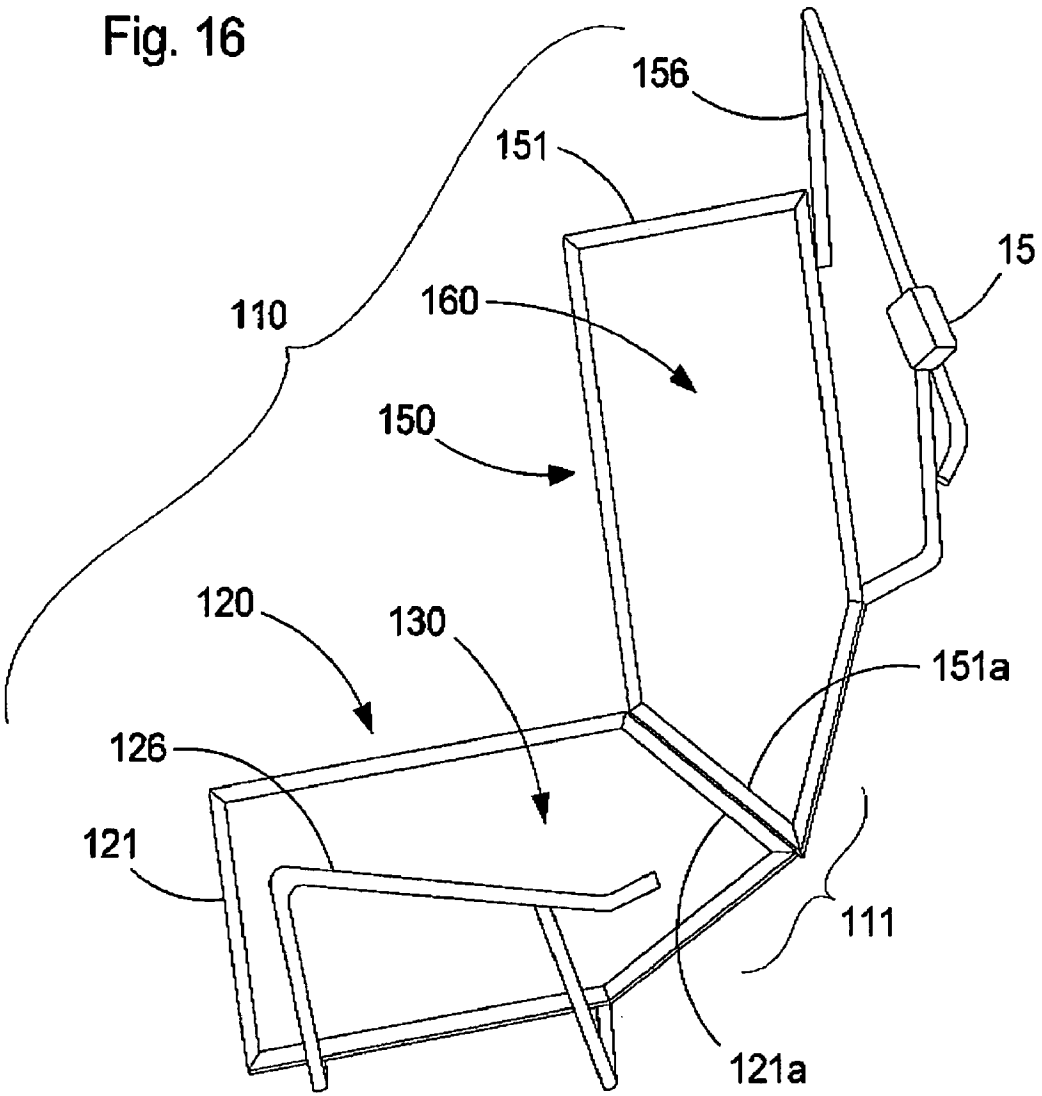
FIG. 16 shows a plan view of yet another exemplary preferred embodiment of the present invention.

It is within the scope of this invention to vary the length, the width and the configuration of the proximal end portions of the platforms to provide longer or shorter and narrower or wider skating surfaces for each of the user's feet to perform and practice skating-type activities comprising plant-thrust-glide motions while wearing the skating footgear or cross-country skis. As exemplified in FIG. 16, that the two-section proximal rails of the base frames 121, 151 can be configured such that when the first sections of the proximal rails 121*a*, 151*a* of the opposed platforms 120, 150 are interconnected, the proximal end of training apparatus 110 provides a conjoined nose section 111 extending backward at an obtuse angle, as compared to a "notched" nose section 1.1 as shown in FIG. 1.

Those skilled in these arts will understand that the plurality of closely spaced together freely spinning rollers configured as disclosed herein provides a very slippery surface suitable for contacting and cooperating with ice skates, roller blades or cross-country skis. As the users' skill, strength and endurance levels increase, it may be desirable to controllably apply resistance to the rollers in order to force the user to exert more effort and force while performing the skating motions. Exemplary methods for providing resistance to the free-spinning rollers include interposing pads of varying density porosity foam between the base frames and roller surface assemblies (not shown). Alternatively, a separate roller bracket support may be provided to communicate and cooperate with each spindle, and interposing a pad of compressible resilient material between the roller bracket supports and the base frame whereby the execution of the plant-thrust-glide motion will cause a sequential compression of the individual rollers as they are contacted by the user's skates causing them to dip below the adjacent uncompressed rollers thereby providing the "feel" of a natural ice surface in addition to increased resistance. Those skilled in these arts will understand that another option for providing increased resistance to skating motions while wearing ice skates or roller blades or cross-country skis is to provide a skating surface comprising a sheet of a durable composite polymer known for its resistance to abrasion and cutting stresses Examples of such materials include UHMW-PE, PVDF resins, extruded acetal copolymers and/or homopolymers, cast nylon 6 polymers, extruded nylon 6/6 polymers, organic/inorganic nano-composite materials, and natural or synthetic rubbers. As exemplified in FIGS. 2*b* and 16, such sheet materials 39, 130, 160 may be placed directly onto the base frames provided with at least one elongate bracing member 23 as shown in FIG. 2(*b*). However, if so desired, a sheet material may be overlaid directly onto a platform provided with a roller surface assembly (not shown). The sheet material may optionally be provided with a plurality of spaced apart bores extending therethrough (not shown). The bores may receive therein or alternatively serve as attachment points for sensing devices configured to communicate and cooperate with electronic devices for purposes of measuring, recording and transmitting selected physical parameters associated with a user's performance of the plant-thrust-glide, turning and stopping motions on the training device.

Figure 6A:
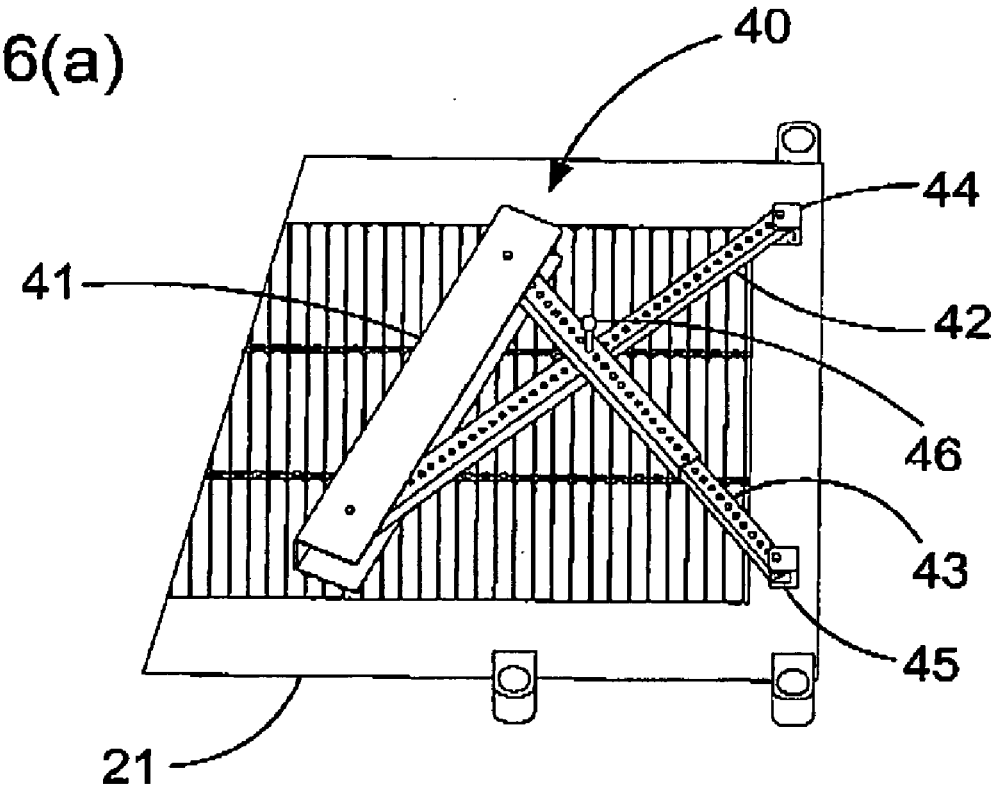
FIG. 6(*a*) is a plan view of another exemplary embodiment shown fixed in an extended position.
Figure 6A:
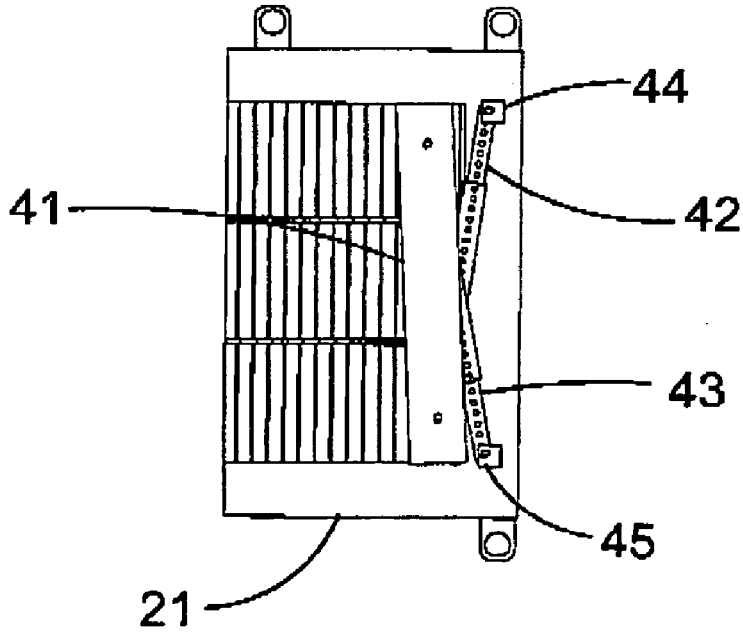
Figure 7A:
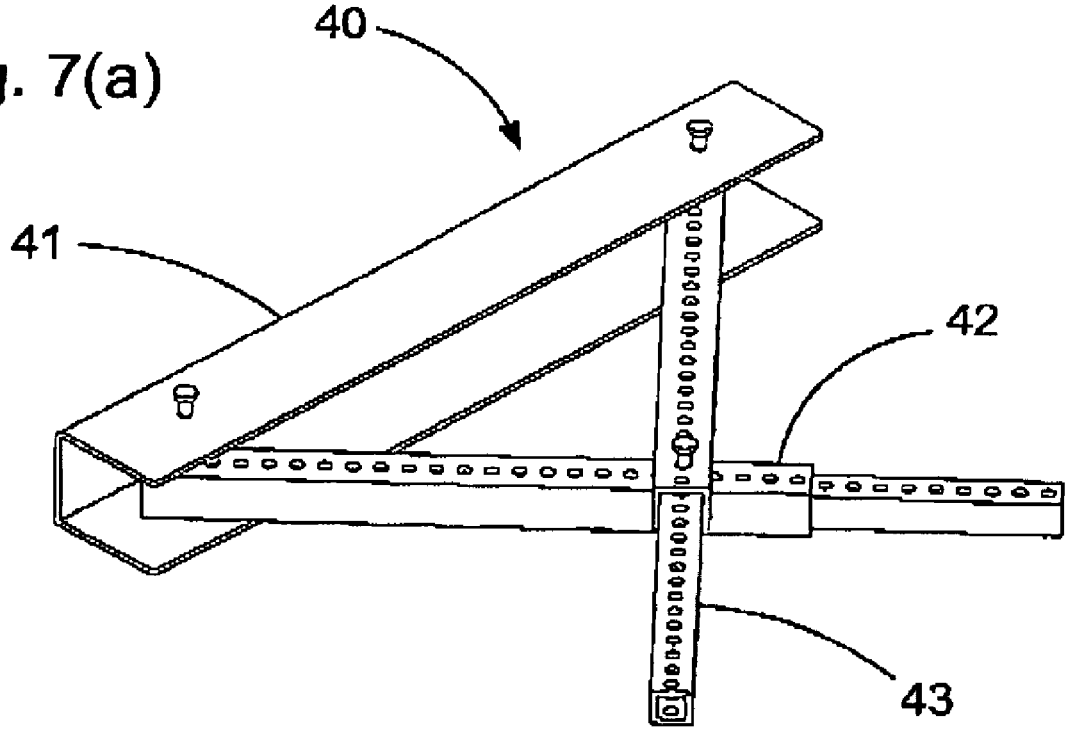
FIG. 7(*a*) is a perspective view from the rear of embodiment from FIG. 6(*a*) shown in an extended position.
Figure 7A:
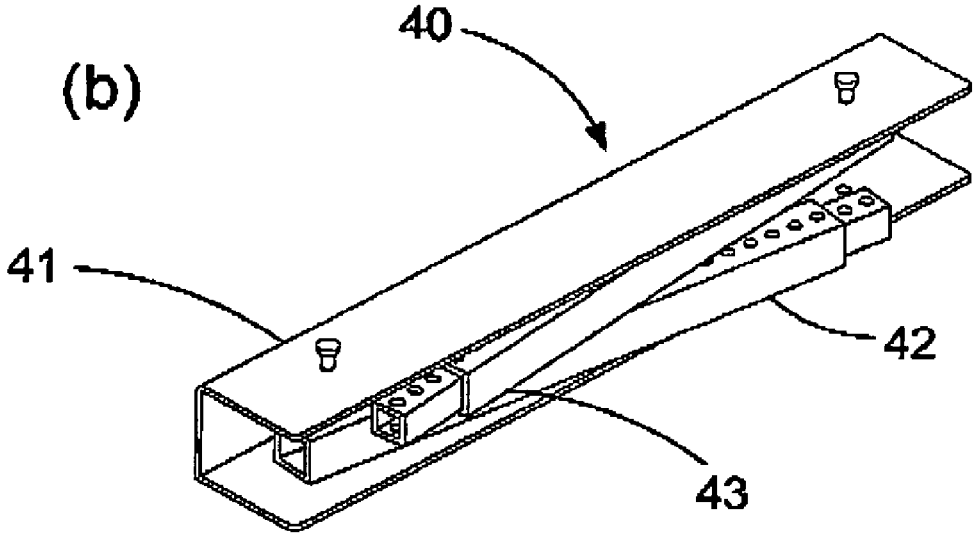

A preferred exemplary embodiment for the articulating foot stop 40 is shown in FIGS. 6 and 7 and generally comprises an elongate stop member 41 pivotably engaged approximate each end with a decussate pair of telescoping struts 42, 43. The opposite ends of the decussate telescoping struts 42, 43 are pivotably engaged with the base frame 21. Each telescoping strut 42, 43, is provided with a plurality of equi-distantly spaced-apart vertically aligned bores extending therethrough. The articulating footstop 40 can be folded against the distal end of the skating platform 20 by compressing the telescoping struts as shown in FIGS. 6(*b*) and 7(*b*). The articulating foot stop 40 and be manipulated to form a desired oblique angle relative to the base frame 21 by extending each decussate telescoping strut to a selected length as shown in FIGS. 6(*a*) and 7(*a*), and then fixing the oblique angle in place by inserting pin 46 through the overlapping bores of struts 43 and 42. If so desired, the user may offset the articulating foot stops 40, 70 at different angles on the skating platforms 20, 50, e.g., as shown in FIG. 1. It is to be noted that the articulating foot stop may be provided with one telescoping strut configured for: (a) controllably pivoting about its mounting points to the elongate stop member and to the base frame, and (b) securely locking into a configured set position. It is also within the scope of this invention to provide an elongate foot stop member configured to demountably engage the opposing sides of the platform in selectable oblique angles relative to the direction of forward propulsion skating motions conducted on the training apparatus.

Figure 8:
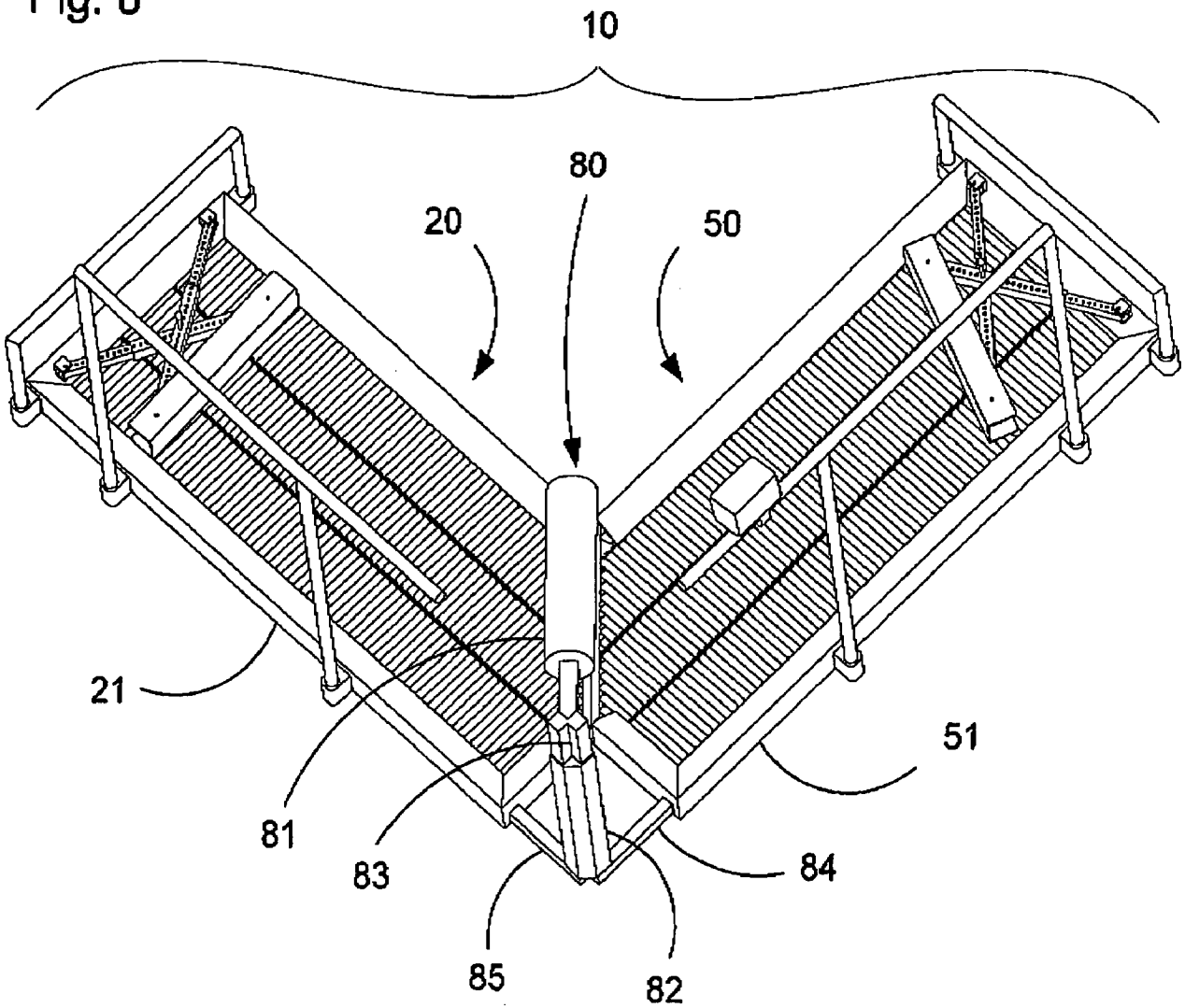
FIG. 8 is a perspective view from the top front, of the embodiment shown in FIG. 1, provided with an optional knee-brace device.
Figure 9:
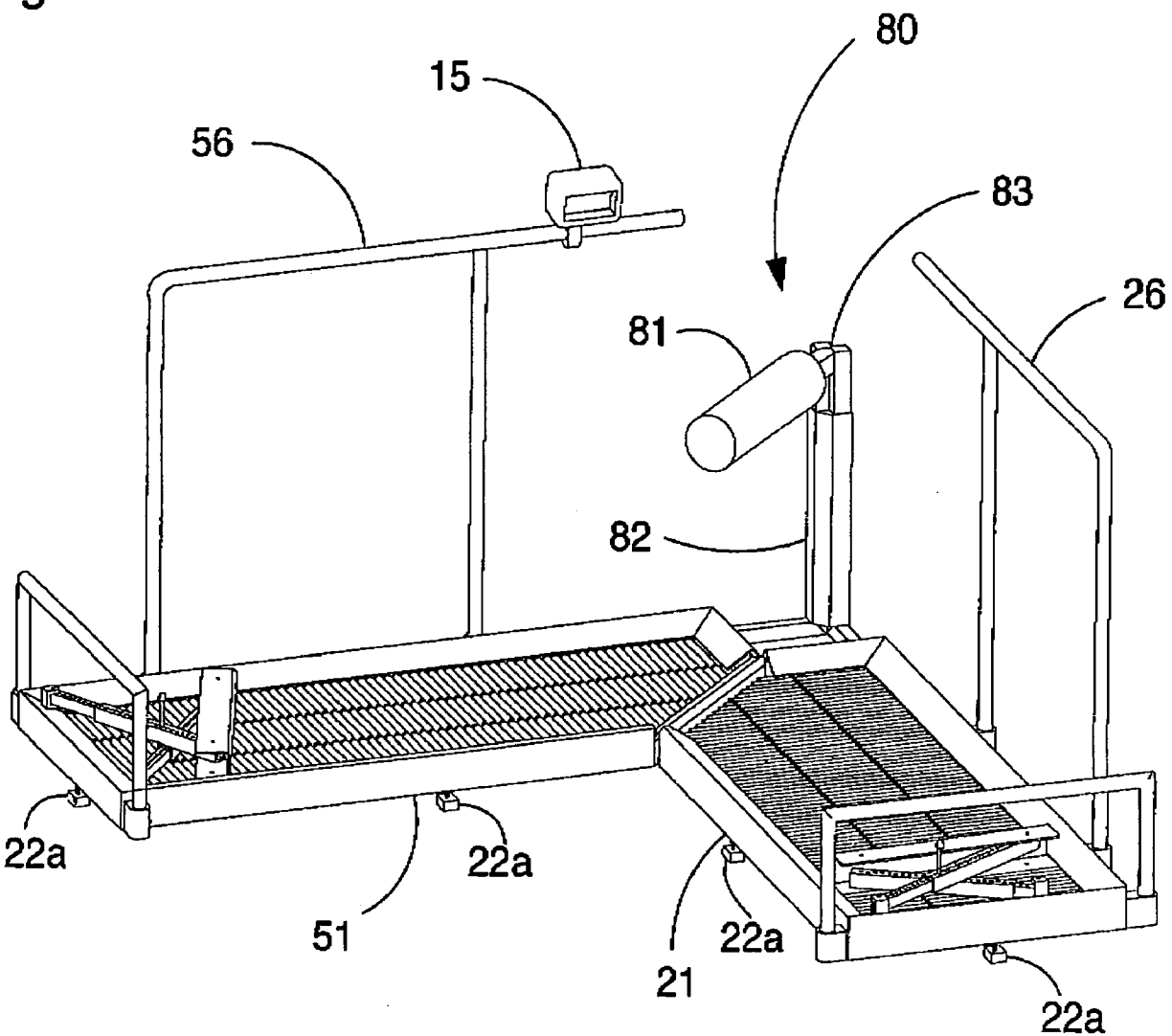
FIG. 9 is a perspective view from the rear of the embodiment shown in FIG. 8.
Figure 10:
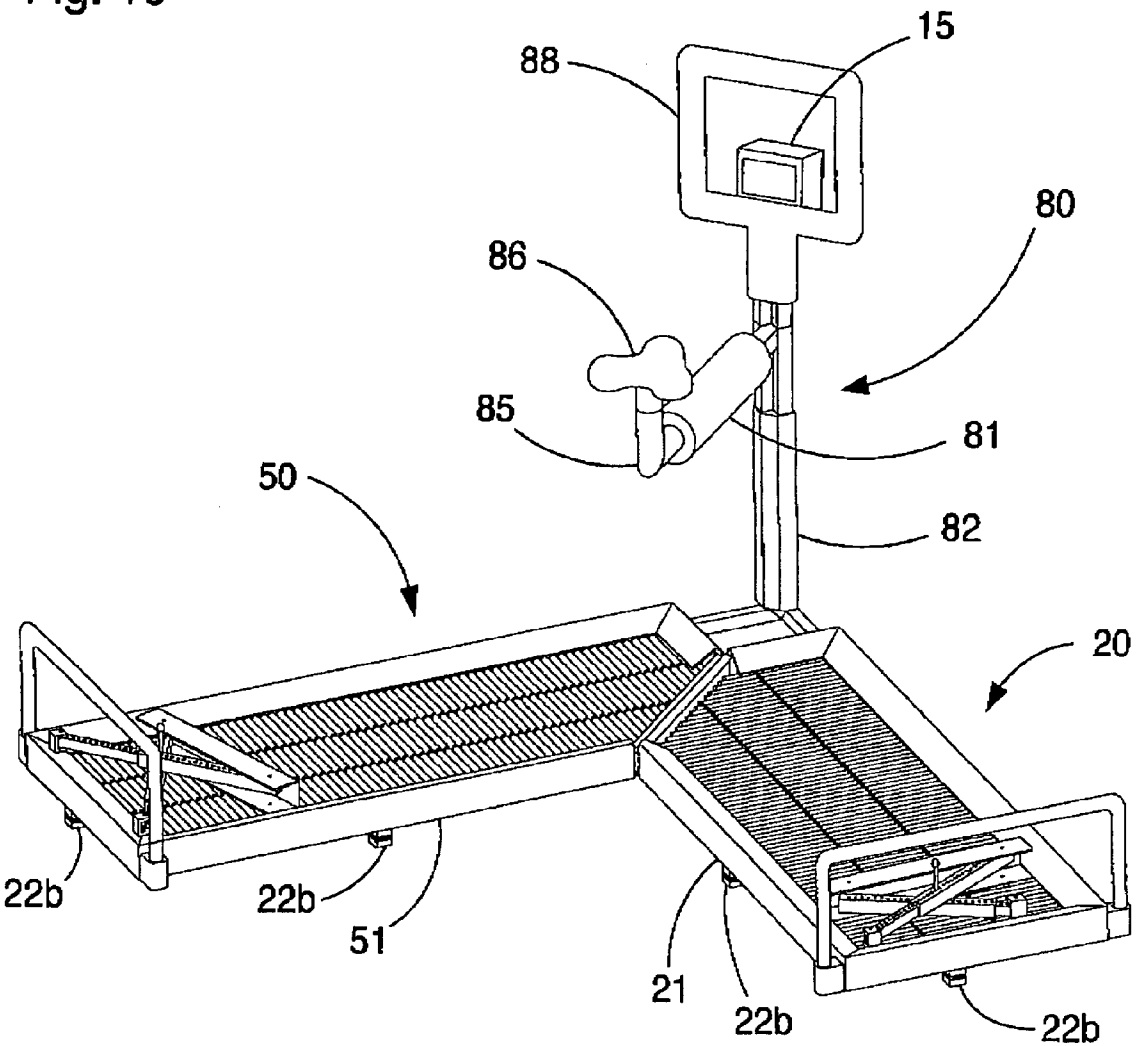
FIG. 10 is a perspective rear view of embodiment from FIG. 8, shown with an alternative mounting arrangement for a grippable hand rail, and with an optional seat support.
Figure 11:
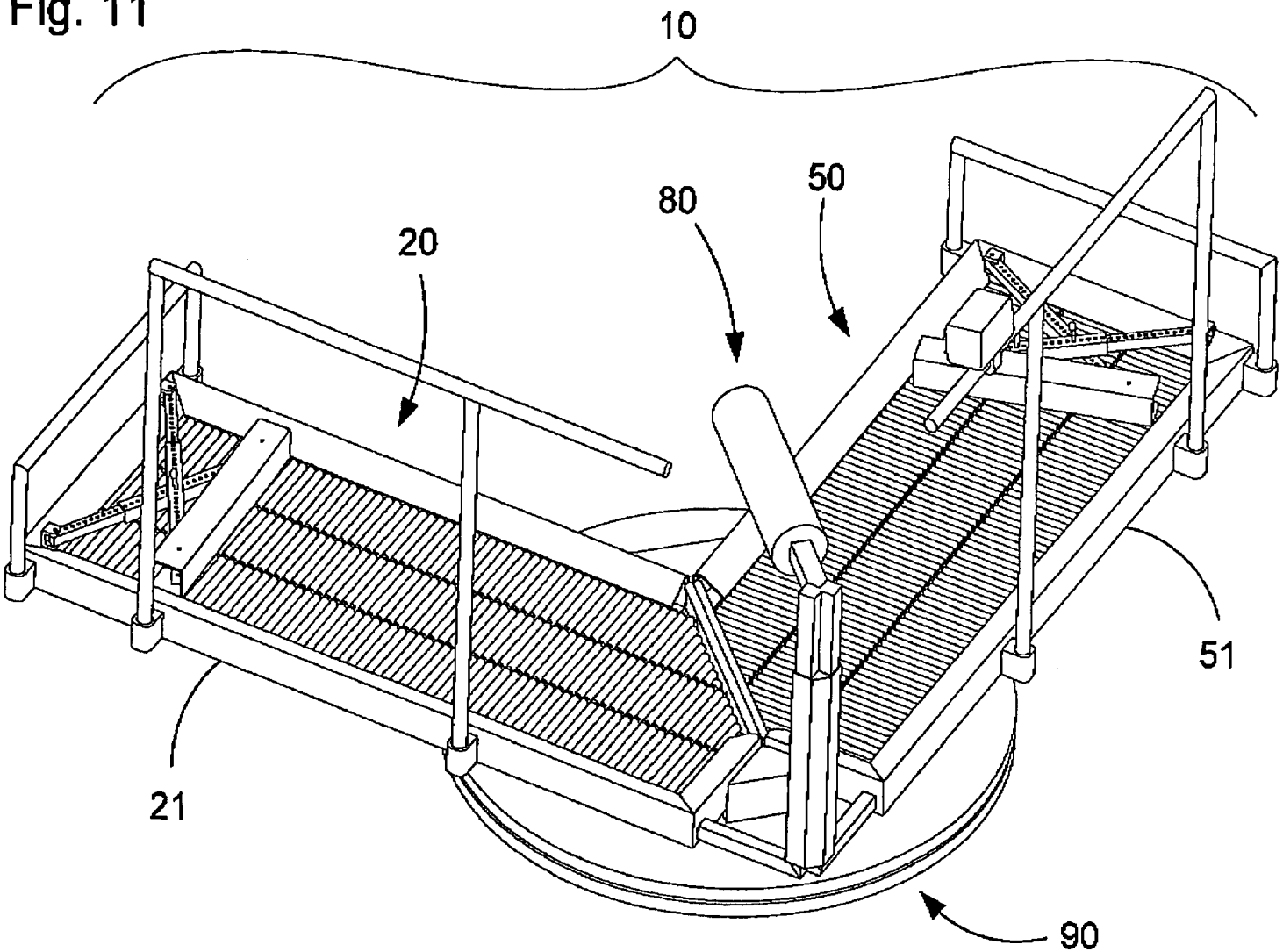
FIG. 11 is a perspective view from the top front, of the embodiment shown in FIG. 1, mounted on a lazy-susan-type carousel.
Figure 12:
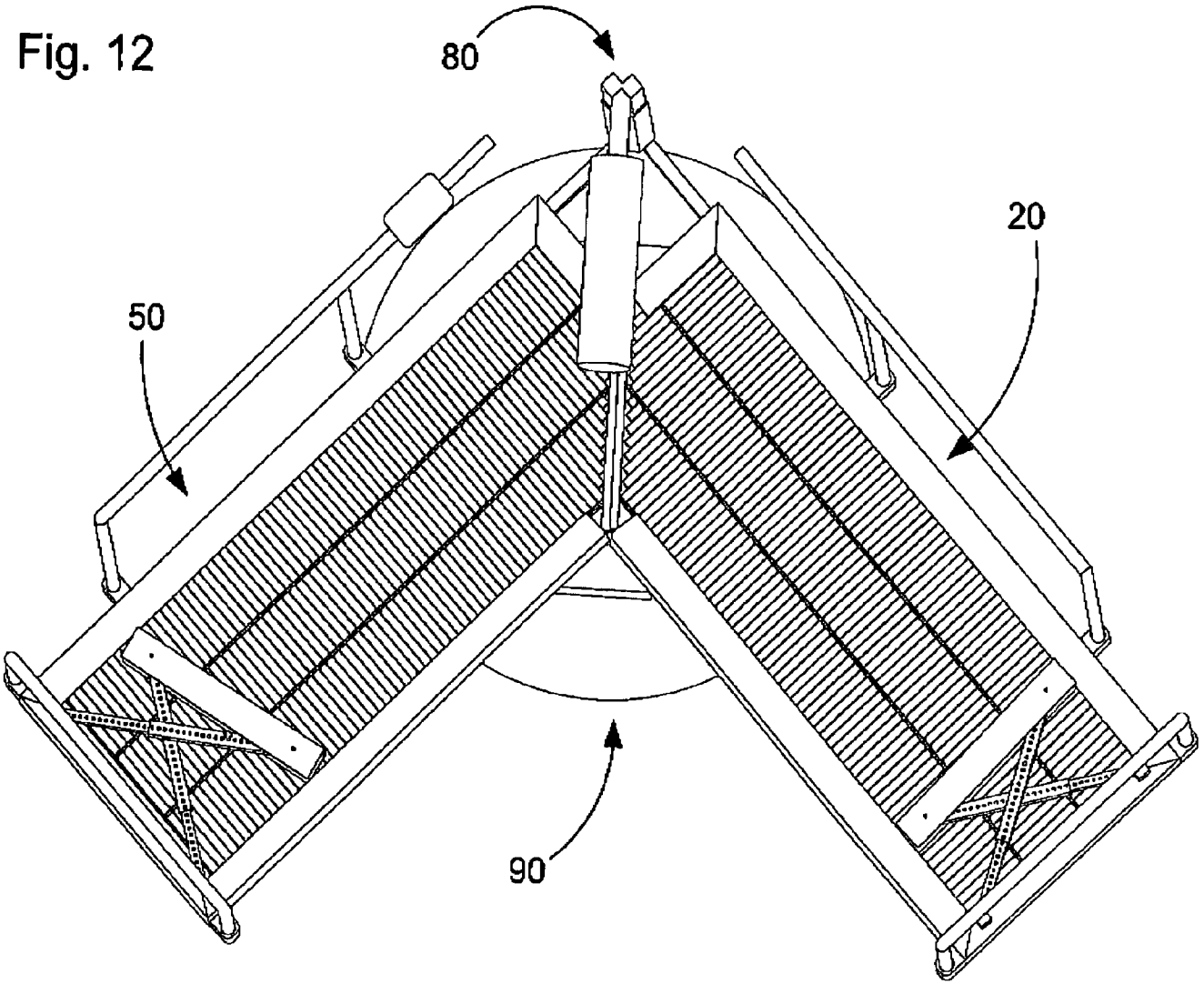
FIG. 12 is a plan view of the embodiment shown in FIG. 11.
Figure 13:
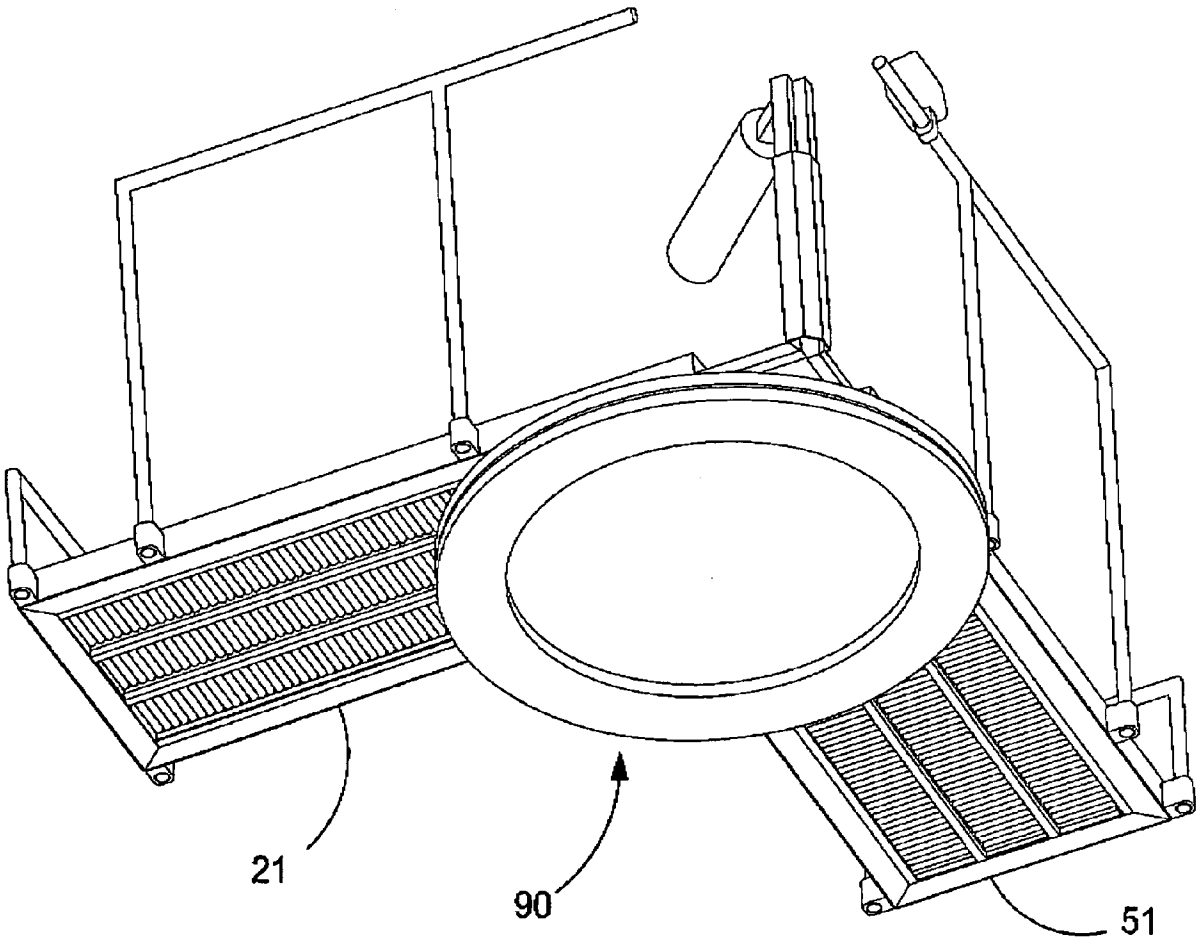
FIG. 13 is a perspective view from the bottom front of the embodiment shown in FIG. 11.
Figure 14:
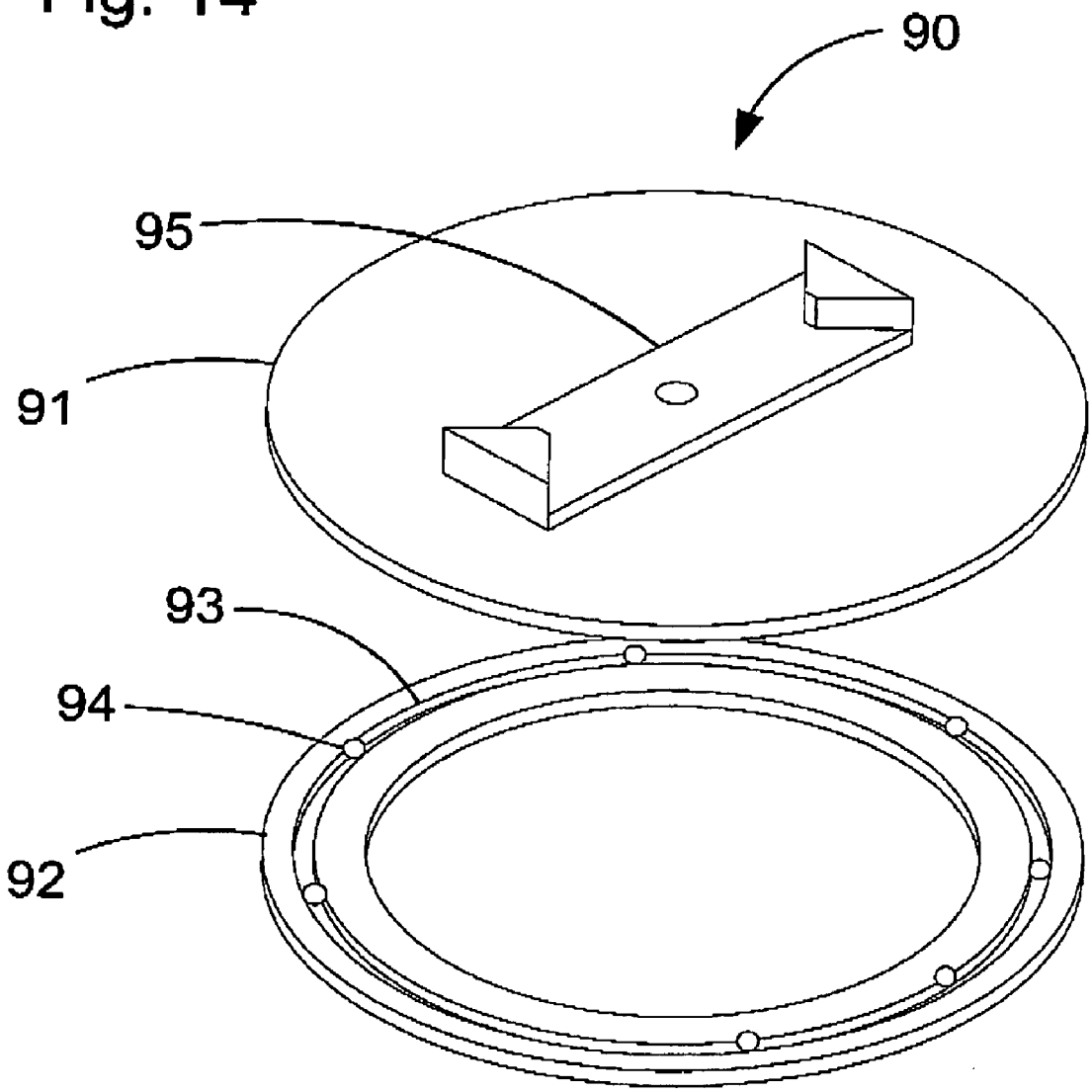
FIG. 14 is an exploded perspective view of the lazy-susan-type carousel shown in FIG. 11.

Beginner skaters and cross-country skiers often have difficulties controlling their ankle and knee muscle groups while learning and practicing the requisite plant-thrust-glide skating motions. FIGS. 8 and 9 show an exemplary embodiment for optionally providing a vertically adjustable knee brace support assembly 80 for the users' knees while they are executing and practicing plant-thrust-glide skating motions on the training apparatus 10 of the present invention. The knee brace support assembly 80 generally comprises a padded member 81 extending horizontally from the front of the training apparatus 10 along an axis juxtaposed over the juncture of the skating platforms 20, 50. The height of the padded member 81 above the skating platforms 20, 50 is raised and lowered to a comfortable height for a user by controllably manipulating a telescoping device 84 interconnected to the padded member 81 by an arm unit 83. The telescoping device is integrally conjoined to a base unit, exemplified in FIG. 8 as elongate members 83, 84, that is engaged with the proximal portions of skating platforms 20, 50. As shown in FIG. 10, the padded knee brace member 81 may be configured to cooperate with an extension member 85 that is provided with a seat element 86 for a user to sit or fall back onto while losing their balance during their use of the training apparatus of the present invention. FIG. 10 also illustrates an alternative guard design 88 configured to cooperate with the knee brace support assembly 80 and an electronic device 115.

The development of users' control and synchronization of their balance and upper body movements while executing plant-thrust-glide skating motions for forward and rearward propulsions, turns and stops can be further enhanced by optionally providing the training apparatus 10 of the present invention with an exemplary embodiment best described as a "lazy-Susan carousel" component designated in FIGS. 11 to 14 with the numeral 90. The carousel component 90 generally comprises a circular bottom plate 92 provided with a channel 93 approximate its outer edge configure to receive and communicate therein with a plurality of ball bearings sized to extend above the upper surface of the bottom plate 92. A cover plate 91 is provided for demountably engaging the bottom plate so that the cover plate can freely rotate in both clockwise and counter-clockwise directions about a vertical axis. The cover plate 91 is provided with an integral mounting bracket 95 configured for demountably engaging the bottom surface of the training apparatus 10, preferably at a balance point (not shown) selected along the juncture of the two skating platforms 20, 50.

Figure 15:
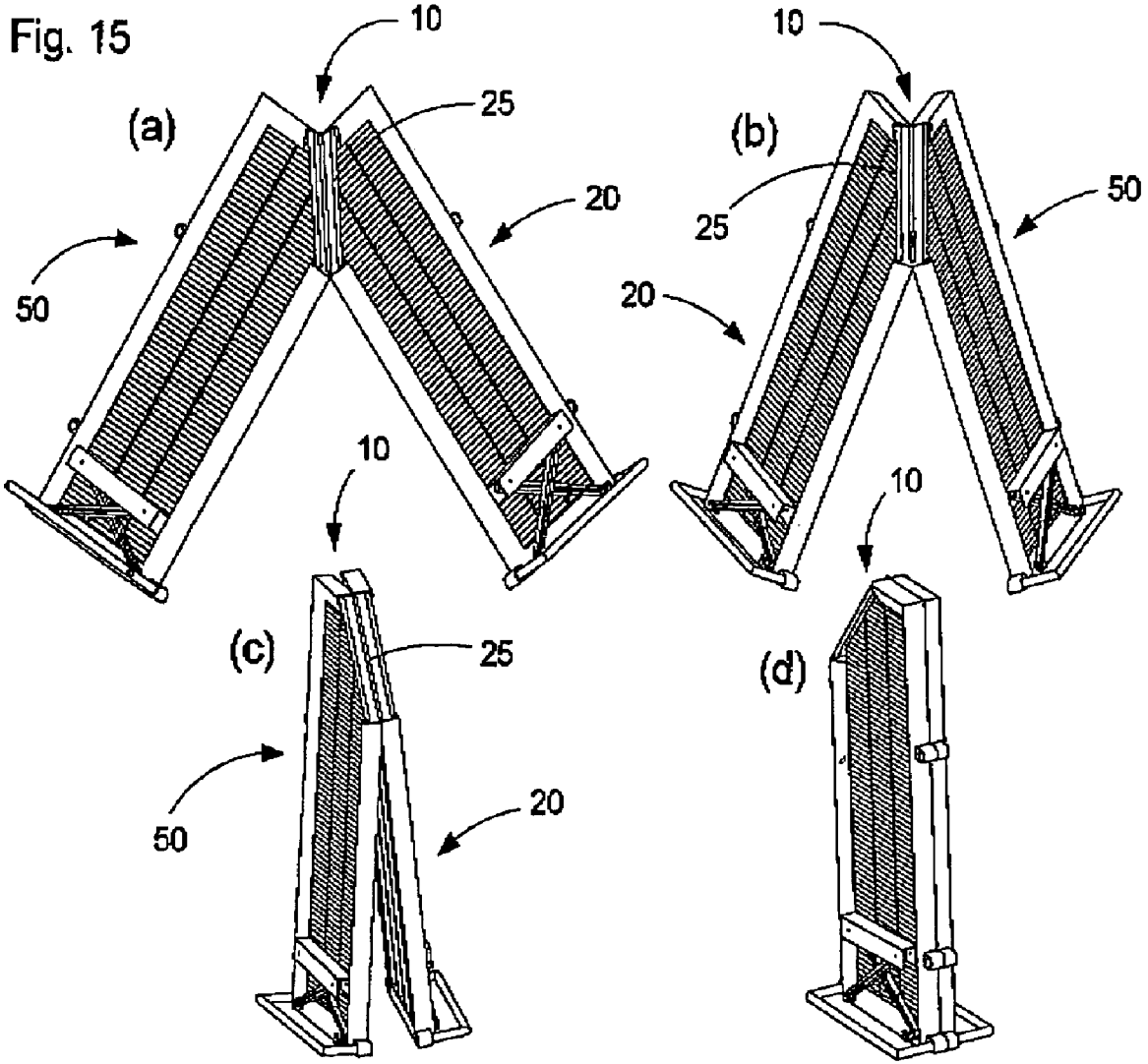
FIGS. 15(*a*)-15(*d*) are sequential perspective views of another exemplary embodiment of the present invention being folded from a "use" position i.e., FIG. 15(*a*) to a folded storage position i.e., FIG. 15(*d*)

Referring to FIG. 15, those skilled in these arts will understand that a hinge device 25 may be provided for interconnecting the two skating platforms 20, 50 at their proximal front corners to enable the folding together of the training apparatus 10 as illustrated by the sequence of FIGS. 15(*a*)-15(*d*), thereby greatly enhancing the ease of storage and/or transport of the training apparatus 10. Conveyance of a folded training apparatus of the present invention can be facilitated by provided a pair of castors or other such devices at the distal end of one of the platforms (not shown).

The training apparatus 10 may be optionally provided with an electronic device 15 configured for monitoring, recording, storing and reporting the user's: (a) vital signs, and (b) execution of physical parameters associated with the plant-thrust-glide motions e.g., angle of foot plant, force of thrust, angle of glide relative to angle of foot plant, length of glide, angle of foot plant for turning, angle of foot plant for stopping thereby providing the user with information regarding their strength, endurance and execution of the individual components of the plant-thrust-glide motions required for skating-type sports activities.

Figure 3A:
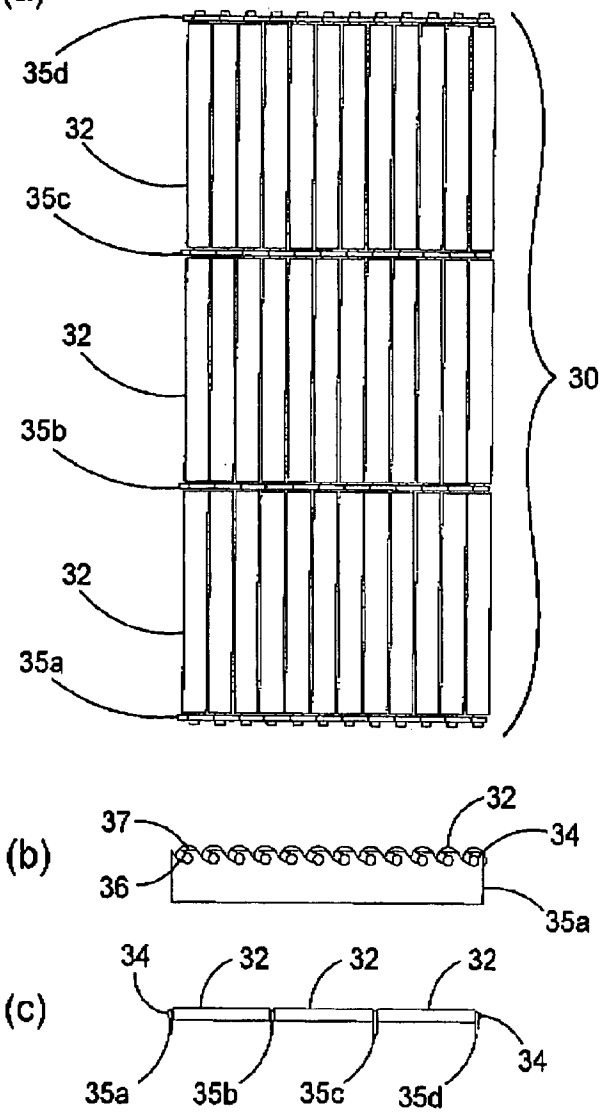
FIG. 3(*a*) is a plan view of the aspect shown in FIG. 2(*a*)
Figure 4A:
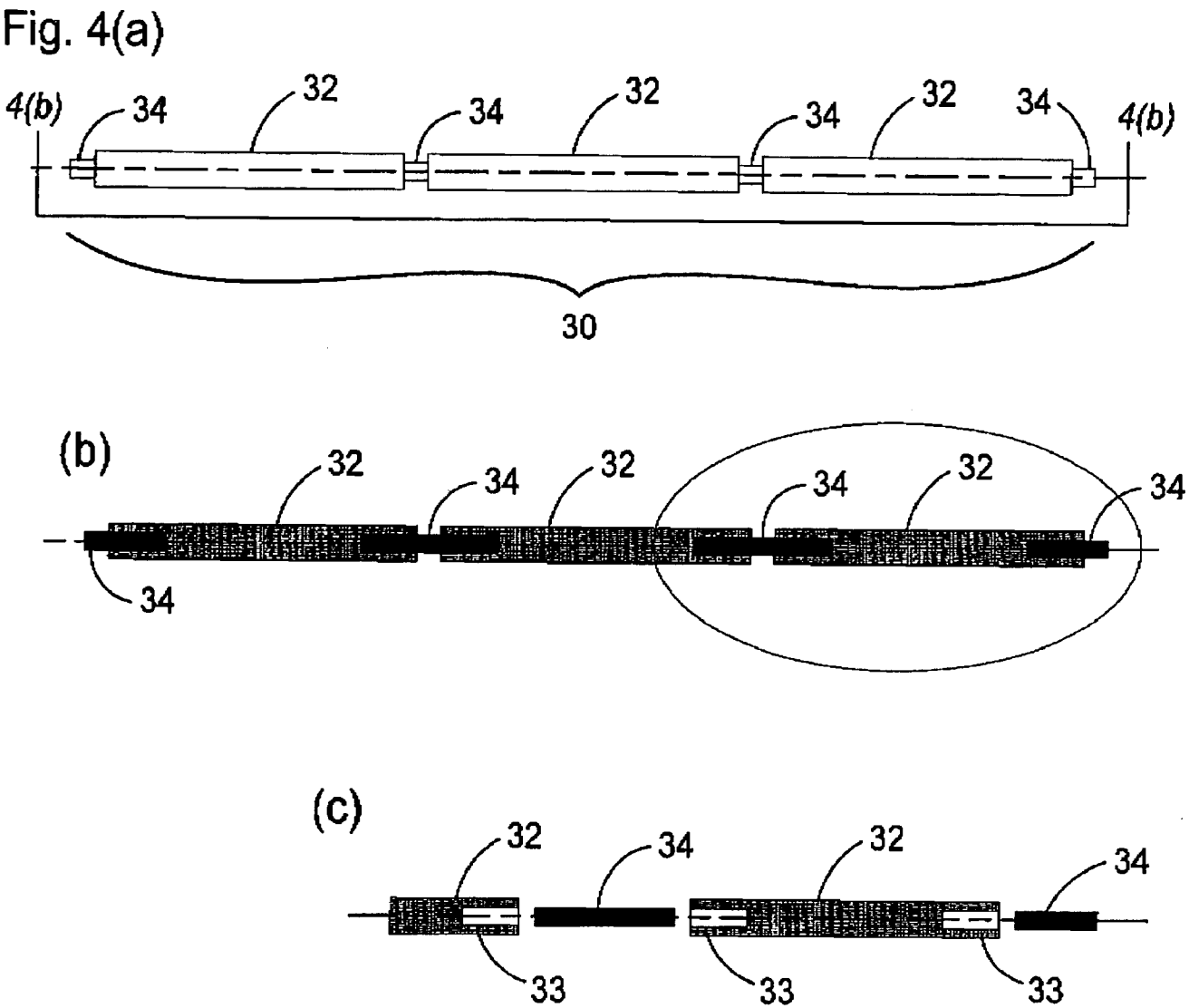
FIG. 4(*a*) is a side view of a component of the aspect shown in FIG. 3(*a*)
Figure 17:
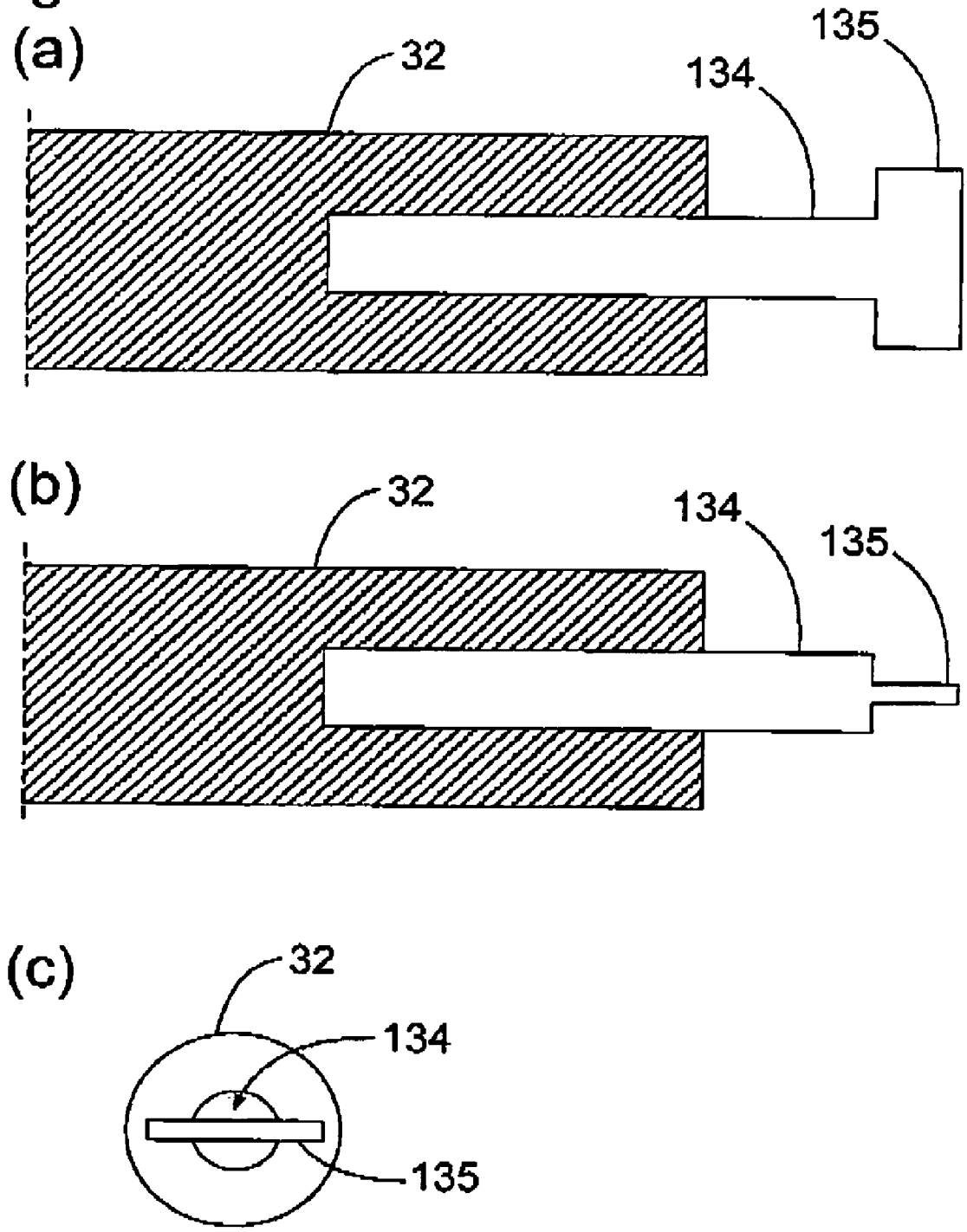
FIG. 17(*a*) is a partial cross-sectional side view of a roller apparatus of the present assembly provided with an end unit configured to mesh with a drive belt.
Figure 18:
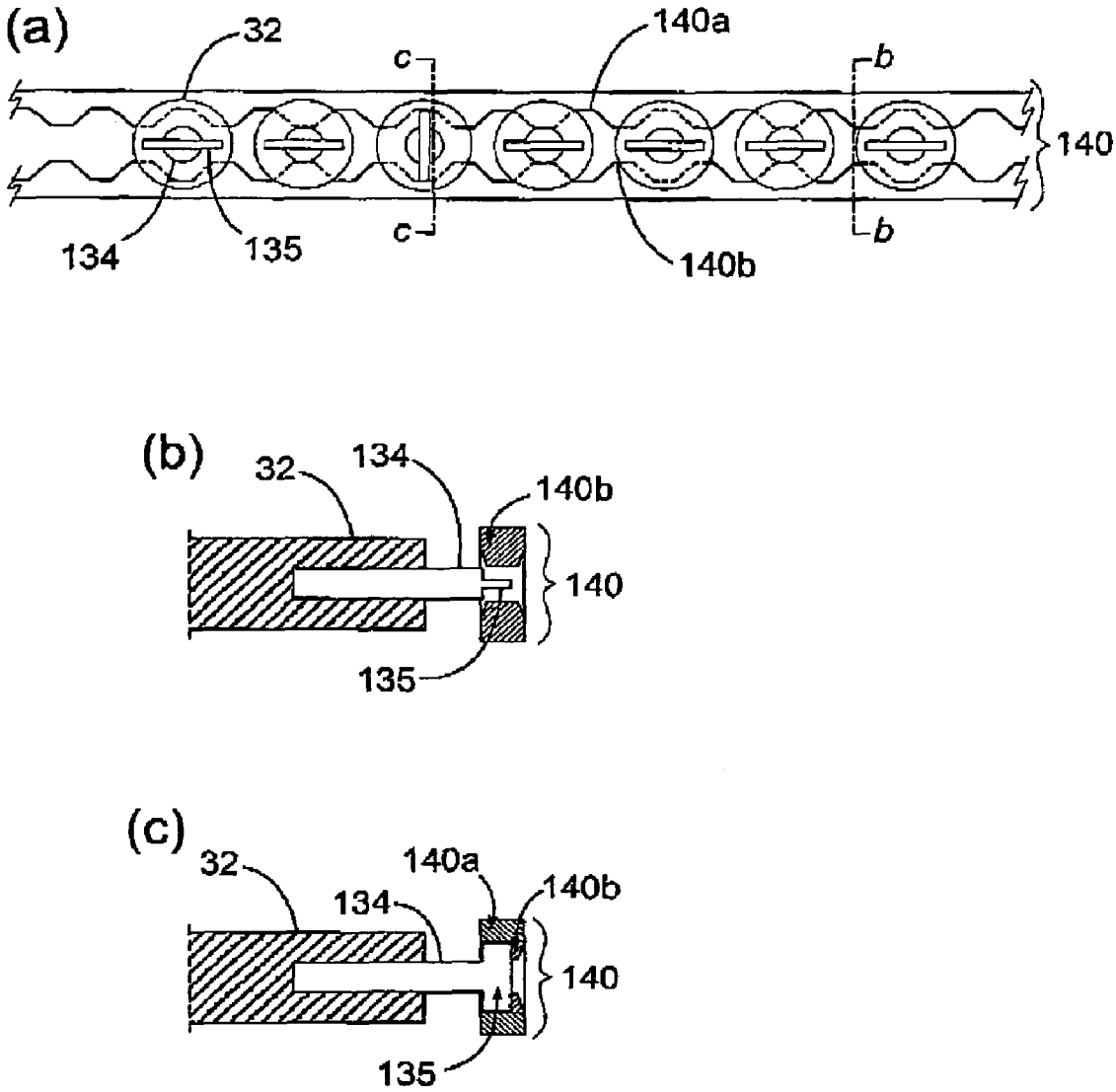
FIG. 18(*a*) is a partial side view showing a plurality of the roller apparatus from FIG. 17(*a*) shown in cooperation with a drive belt.

An exemplary embodiment of the present invention configured for detecting and monitoring the physical parameters associated with a user's execution of the plant-thrust-glide foot and leg motions is illustrated in FIGS. 17 and 18 wherein the outermost freely rotatable rollers 32 of a roller assembly are fitted with a spindle 134 provided with a flattened elongate terminal end 135 that, when spindle 134 is positioned to rotatingly communicate with a yoke 36 of a support bracket 35 (support bracket 35 shown in FIG. 3(*b*)), the flattened elongate end is positioned interposed the support bracket 35 and base frame member 21*a* (base frame member 21*a* shown in FIG. 2(*a*)). The spindle 135 may be optionally provided with a flattened elongate section approximate one end of the spindle. An endless flexible drive belt 140 provided with regularly spaced apart inward-facing teeth defined by valley portions 140*a* and ridged portions 140*b* encircles the plurality of elongate terminal ends 135 of spindles 134 extending from the outermost freely rotatable rollers 32 of each roller unit. The equidistant spacing of the valley and ridged portions 140*a* and 140*b* of the drive belt 140 is configured to: (a) pass freely around elongate terminal ends 135 that do not have a load applied to them, and (b) to engage the elongate terminal ends 135 in the valley portions 140*a* of the drive belt 140 when there is a load applied to the roller 32*s* communicating with the elongate terminal ends 135 as a consequence of pressures from a user's plant-thrust-glide motions. In a "neutral" mode, the elongate terminal ends 135 will be parallel to the line of the belt and thus, movement of the belt 140 will not communicate with nor rotate the spindle 134. Furthermore, in the neutral mode, the movement of the belt drive 140 caused rotation of other roller units will not communicate nor move the roller unit that is not engaged by a user. In a situation in which the elongate terminal end 135 of a roller unit that is engaged by a user's plant-thrust-glide motions, is not parallel to the travel line of the belt drive 140, the belt drive 140 will be able to communicate with the elongate terminal end 135 by engaging the terminal end 135 in the valley portion 140*a* of the belt drive 140. If the roller unit is not moving in response to pressure applied by the user, the belt drive's movement from previously engaged rollers will cause the elongate terminal end 135 to rotate until it is in the "neutral" mode. When the roller is moved by force applied from a user's plant-thrust-glide motion, the elongate terminal end 135 will rotatingly communicate with the belt drive 140 and thus cause the belt drive 140 to move in the direction of the terminal end's rotation. The communication of the elongate terminal end 135 with the belt drive 140 will be instantaneous with the onset of motive force from the user and will continue for the duration of the contact of the roller with the user's footgear. Once the elongate terminal end 135 stops moving, the belt drive 140 will also stop moving and will enter the "neutral" mode until another roller is engaged by the user. The belt drive may travel along one or more pulleys interposed the outer support bracket and the outer base frame member, and tension points may be provided to tighten the belt drive if so desired. The belt drive may optionally be threaded above and below adjacent elongate terminal ends 135 or alternatively, the belt can just pass above and below the rollers in a straight line. An electronic sensor device and/or encoding device may be provided to capture the data of generated by the user-generated movement of the elongate terminal ends 135. The electronic data may be collected, retrieved, captured, and delivered to computerized data processing and storage devices using electronic equipment and systems. Data captured and collected relating to the amount and speed of the elongate terminal end's 135 movement can be process to determine the length, time, and force of each stride. It should also be noted that the elongate terminal ends can be configured to provide resistance to rollers in opposition to the force applied by the user thereby requiring the user to impart more force during the exercising process. There may be guiding rails provided to retain the belt drive within a preferred travel track about the plurality of elongate terminal ends. There may be a plurality of belt drives provided adjacent to each other and configured to cooperate with each elongate terminal end so that a movement of a first belt drive will affect movement in a second belt drive. The provision of a second belt to communicate with an elongate terminal end will add more resistance to the rollers. Also, having one or more singular belts, or in couples, will individualize the resistance so that one area of rollers can have more resistance than others. For example, at the beginning of the stride, due to the body mechanics, the user would be able to exert more force on the rollers and thereby would require more resistance as compare to the end of the stride where the force is not as great coming from the stride. With the system of belts, it can provide a more individualize resistance. Also, having one or more belts running side by side, will also provide more resistance. One belt alone can act both as a resistance and also provide the information to the data concerning the length, speed, and force of stride; and additional belts running alongside will add more resistance. Also, the width of the belts can also be used for varying the resistance, and as well, the width of the flat blade of the roller can also vary and providing different resistance. If so desired, a pair of synchronized electric motors may be fitted to the training apparatus wherein each exercise platform communicates and cooperates with one of the electric motors. It is preferred that each electric motor is mounted in a position wherein it controllably communicates and cooperates with an endless drive belt system as disclosed above, said endless belt drive system configured to communicate and cooperate with an exercise surface comprising a plurality of roller units whereby the exercise surface is controllably manipulable to provide resistive forces to a user's skating motion.

While the present invention is contemplated as being particularly well-suited for the execution, practice and development of the plant-thrust-glide skating motions while wearing ice skates or roller blades or cross-country skis thereon, I have also found that my training apparatus provided with either a roller surface apparatus or a sheet material, is well-suited for performing thereon aerobics and/or plyometric exercises while wearing sneaker-type sports footwear. Furthermore, I found that sports foorgear provided with cleats cooperating with their soles, e.g., soccer shoes, football shoes, baseball shoes, are particularly useful for performing aerobics and plyometric exercises on my training apparatus provided with roller surface apparatus.

While this invention has been described with respect to the preferred embodiments, it is to be understood that various alterations and modifications can be made to components of the training apparatus within the scope of this invention, which are limited only by the scope of the appended claims.

What is claimed is:

1. An ice-skating training apparatus for exercising and conditioning by ice-skating thereon, the ice-skating training apparatus comprising:

a pair of opposed matching elongate platforms, said platforms interconnected at their opposing front corners and extending backward therefrom wherein each platform is provided with a base frame structure having two opposing side rails, a distal rail extending between one set of juxtaposed ends of the two side rails, and a two-section proximal rail extending between the opposite juxtaposed ends of the two side rails wherein a first section of the proximal rail is configured to extend from the side rail at an obtuse angle, whereby abutting the first section of the proximal rail of a first base frame structure with the first section of the proximal rail of a second base frame structure forms an angle selected from the range consisting of 90° to 10°;

a pair of matching exercise surface assemblies, said exercise surface assemblies selected for controllably engaging and disengaging a user's ice skates thereon, each of said exercise surface assemblies configured for mountable engagement therein with one of the matching platforms;

at least one user-graspable guardrail configured for demountable engagement with a side portion of said training apparatus; wherein each exercise surface assembly is provided with a plurality of equi-distantly spaced apart roller units demountably communicating with a plurality of roller support brackets and an endless drive belt laterally adjacent the exercise surface assembly, said roller support brackets demountably engaged with said platform, wherein each roller unit comprises a plurality of spaced apart free-spinning rollers interconnected end-to-end; the ends of each roller provided with identical bores for receiving a spindle thereinto each end, said spindle demountably communicating with a hook-shaped receptacle depending from the top of one of said roller support brackets; wherein each of said roller units has a first spindle extending therefrom an outward-facing bore in a terminal roller at a first end of the roller unit for rotatingly communicating with a roller support bracket, and a second spindle extending therefrom the second end of the roller unit, the second spindle engaging a plurality of teeth provided therefor in the endless drive belt when a pressure is applied to the roller unit.

2. An ice-skating training apparatus according to claim 1 wherein each base frame structure is provided with at least one cross-bracing member interposed and cooperating with the two side rails.

3. An ice-skating training apparatus according to claim 1 wherein each base frame structure is provided with at least one elongate bracing support member interposed the two side rails and integrally engaged with a rear rail and a front rail.

4. An ice-skating training apparatus according to claim 3 wherein the bracing support member is provided with an upward facing channel.

5. An ice-skating training apparatus according to claim 3 wherein at least one cross-bracing member is integrally interposed the elongate bracing support member and the side rail.

6. An ice-skating training apparatus according to claim 1 wherein a plurality of spaced-apart raising/lowering devices are mounted to the bottom surface areas of a front section, a rear section, a left section and a right section of said training apparatus, said plurality of spaced apart devices configured for controllably raising and lowering the front, rear, left and right sections of said training apparatus.

7. An ice-skating training apparatus according to claim 1 wherein each exercise surface assembly comprises a plurality of equidistantly spaced apart free-spinning rollers cooperating with a pair of roller support brackets, said roller support brackets demountably engaged with the base frame structure, wherein the ends of each roller provided with a bore for receiving a spindle therein configured for demountably communicating with a hook-shaped receptacle depending from the top of said roller support brackets.

8. An ice-skating training apparatus according to claim 7 wherein each spindle demountably communicates and cooperates with an individual roller support bracket 9. An ice-skating training apparatus according to claim 8 wherein at least one roller support bracket is provided with a demountable guard apparatus configured to retain therein the roller support bracket each spindle communicating therewith the roller support bracket.

10. An ice-skating training apparatus according to claim 7 wherein each exercise surface assembly is further provided with a device configured for controllably applying resistance to said free-spinning rollers.

11. An ice-skating training apparatus according to claim 7 wherein said device configured for controllably applying resistance to said free-spinning rollers comprises a compressible resilient member interposed the roller support brackets and the base frame structure.

12. An ice-skating training apparatus according to claim 7 wherein each exercise surface assembly is further provided with a device configured for controllably applying resistance to said free-spinning rollers.

13. An ice-skating training apparatus according to claim 12 wherein said device configured for controllably applying resistance to said free-spinning rollers comprises a compressible resilient member interposed the roller support brackets and the base frame structure.

14. An ice-skating training apparatus according to claim 7 wherein the plurality of rollers are equally spaced apart by a distance of 5 mm or less.

15. An ice-skating training apparatus according to claim 7 wherein the plurality of rollers comprise a material resistant to abrasion and cutting, said material selected from the group consisting of ultra-high molecular weight polyethylene, extruded polyvinylidene fluoride resins, extruded acetal copolymers, extruded acetal homopolymers, cast nylon 6 polymers, extruded nylon 6/6 polymers, acetyl resins nanocomposite materials, natural rubbers and synthetic rubbers.

16. An ice-skating training apparatus according to claim 1 wherein each spindle demountably communicates and cooperates with an individual roller support bracket.

17. An ice-skating training apparatus according to claim 1 wherein at least one roller support bracket is provided with a demountable guard apparatus configured to retain therein the roller support bracket each spindle communicating therewith the roller support bracket.

18. An ice-skating training apparatus according to claim 1, wherein each exercise surface assembly is further provided with a device configured for controllably applying resistance to said free-spinning rollers.

19. An ice-skating training apparatus according to claim 18 wherein said device configured for controllably applying resistance to said free-spinning rollers comprises a compressible resilient member interposed the roller support brackets and the base frame structure.

20. An ice-skating training apparatus according to claim 1 wherein the plurality of rollers are equally spaced apart by a distance of 5 mm or less.

21. An ice-skaking training apparatus according to claim 1 wherein the plurality of rollers comprise a material resistant to abrasion and cutting, said material selected from the group consisting of ultra-high molecular weight polyethylene, extruded polyvinylidene fluoride resins, extruded acetal copolymers, extruded acetal homopolymers, cast nylon 6 polymers, extruded nylon 6/6 polymers, acetyl resin, nanocomposite materials, natural rubbers and synthetic rubbers.

22. An ice-skating training apparatus according to claim 1 wherein said training apparatus is provided with an electronic device configured to cooperate with endless drive belt when a pressure is applied to the roller unit, to detect, measure and report at least one physical performance attribute selected from the group comprising degree of force exerted, length of thrust, length of glide, time duration of a plant-thrust-glide motion, and distribution of body weight from foot-to-foot.

23. An ice-skating training apparatus according to claim 22 wherein said electronic device is configured to communicate with a device configured for executing at least one task selected from the group consisting of data transfer, data processing, and data storage.

24. An ice-skating training apparatus according to claim 1 wherein said training apparatus is provided with a pair of synchronized electric motors configured to communicate and cooperate with the pair of exercise surfaces, said exercise surface provided with a plurality of roller units configured to cooperate with an endless drive belt system.

25. An ice-skating training apparatus according to claim 1 wherein a pair of spindles is provided, each having a first end configured for rotatingly communicating with the outward-facing bore of a terminal roller comprising each roller unit, and a second end configured for engaging and cooperating with an endless drive belt provided with a plurality of teeth, when a pressure is applied to the roller unit 26. An ice-skating training apparatus according to claim 25 wherein said training apparatus is provided with an electronic device configured to cooperate with endless drive belt when a pressure is applied to the roller unit, to detect, measure and report at least one physical performance attribute selected from the group comprising degree of force exerted, length of thrust, length of glide, time duration of a plant-thrust-glide motion, and distribution of body weight from foot-to-foot.

27. An ice-skating training apparatus according to claim 26 wherein said electronic device is configured to communicate with a device configured for executing at least one task selected from the group consisting of data transfer, data processing, and data storage.

28. An ice-skating training apparatus according to claim 25 wherein said training apparatus is provided with a pair of synchronized electric motors configured to communicate and cooperate with the pair of exercise surfaces, said exercise surface provided with a plurality of roller units configured to cooperate with an endless drive belt system.

29. An ice-skating training apparatus according to claim 1 wherein a controllably pivotable, and lockable footstop apparatus configured for cooperating with one of the exercise surface assemblies, is provided for demountably engaging the opposing sides of an elongate platform.

30. An ice-skating training apparatus according to claim 1 wherein a controllably extendable, pivotable, and lockable footstop apparatus configured for cooperating with one of the exercise surface assemblies, is provided for demountably engaging the distal end of one of the opposed matching elongate platforms.

31. An ice-skating training apparatus according to claim 30 wherein the footstop apparatus comprises an elongate footstop member, at least one controllably telescopic arm unit having one end configured for pivotably engaging the elongate footstop and the opposite end configured for pivotably engaging the distal end of the elongate platform, and a locking device for releasably engaging the at least one telescopic arm in a fixed position.

32. An ice-skating training apparatus according to claim 1 provided with an electronic device mountable on said guardrail, the electronic device configured to cooperate with the training apparatus for measuring and reporting a user's vital signs during use of said training apparatus.

33. An ice-skating training apparatus according to claim 32 wherein said electronic device is configured to cooperate with the training apparatus during its use for measuring and reporting of at least one physical performance attribute selected from the group comprising degree of force exerted, length of thrust, length of glide, time duration of a plant-thrust-glide motion, and distribution of body weight from foot-to-foot.

34. An ice-skating training apparatus according to claim 32 wherein said electronic device is configured to communicate with a device configured for executing at least one task selected from the group consisting of data transfer, data processing, and data storage.

35. An ice-skating training apparatus according to claim 33 wherein said electronic device is configured to communicate with a device configured for executing at least one task selected from the group consisting of data transfer, data processing, and data storage.

* * * * *